US010474086B2

(12) United States Patent
Tomita et al.

(10) Patent No.: US 10,474,086 B2
(45) Date of Patent: Nov. 12, 2019

(54) IMAGE FORMING APPARATUS CAPABLE OF ADJUSTING PRINT POSITION OF IMAGE ON RECORDING PAPER

(75) Inventors: Norio Tomita, Osaka (JP); Yasuaki Fukada, Osaka (JP); Hidetoshi Atsumi, Osaka (JP); Koji Wakamoto, Osaka (JP); Atsushi Ogo, Osaka (JP); Ryosuke Sakai, Osaka (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 935 days.

(21) Appl. No.: 13/455,289

(22) Filed: Apr. 25, 2012

(65) Prior Publication Data

US 2012/0275802 A1 Nov. 1, 2012

(30) Foreign Application Priority Data

Apr. 26, 2011 (JP) ..... 2011-098298

(51) Int. Cl.
*G03G 15/00* (2006.01)
*G03G 15/23* (2006.01)

(52) U.S. Cl.
CPC ..... *G03G 15/6564* (2013.01); *G03G 15/6561* (2013.01); *G03G 15/235* (2013.01); *G03G 2215/00569* (2013.01); *G03G 2215/00599* (2013.01); *G03G 2215/00721* (2013.01); *G03G 2215/00734* (2013.01); *G03G 2215/00742* (2013.01)

(58) Field of Classification Search
USPC ..... 399/388, 391, 393–396
See application file for complete search history.

(56) References Cited

U.S. PATENT DOCUMENTS 4,956,651 A * 9/1990 Emori ..... 347/264
7,062,217 B2 * 6/2006 Tsukamoto et al. ..... 399/401
2004/0136734 A1 * 7/2004 Yokobori et al. ..... 399/23
(Continued)

FOREIGN PATENT DOCUMENTS

JP 64-9473 1/1989
JP 08-006332 A 1/1996
JP 8-335018 12/1996
(Continued)

*Primary Examiner* — Judy Nguyen
*Assistant Examiner* — Quang X Nguyen
(74) *Attorney, Agent, or Firm* — Birch, Stewart, Kolasch & Birch, LLP

(57) ABSTRACT

The image forming apparatus includes: a paper feed unit; a print unit; a registration roller; a sheet leading end sensor provided downstream, in a transport direction of the recording paper, of the registration roller; a time measuring unit for measuring a time from a start point of transportation of the recording paper by the registration roller to a point of detection of the leading end of the recording paper by the sheet leading end sensor; a memory unit for storing a reference image forming time and a reference time; a print control unit; and an arithmetic unit for obtaining a difference between the reference time and the time detected by the time measuring unit. The print control unit adjusts the length of the image forming period in accordance with the adjusted image forming time determined based on the difference obtained by the arithmetic unit and the reference image forming time.

8 Claims, 8 Drawing Sheets

(56) References Cited

U.S. PATENT DOCUMENTS

2007/0280764 A1* 12/2007 Nakazawa ..... G03G 15/6564
399/394

FOREIGN PATENT DOCUMENTS

| | | | | |
|---|---|---|---|---|
| JP | 2004-256243 | A | | 9/2004 |
| JP | 2005-186335 | A | | 7/2005 |
| JP | 2005283675 | A | * | 10/2005 |
| JP | 2006-248644 | A | | 9/2006 |
| JP | 2006-293280 | A | | 10/2006 |
| JP | 2006-301087 | A | | 11/2006 |

* cited by examiner

IMAGE FORMING APPARATUS CAPABLE OF ADJUSTING PRINT POSITION OF IMAGE ON RECORDING PAPER

CROSS-REFERENCE TO RELATED APPLICATION

This application claims priority under 35 U.S.C. § 119(a) on Patent Application No. 2011-098298 filed in Japan on Apr. 26, 2011, the entire contents of which are herein incorporated by reference.

BACKGROUND OF THE INVENTION

Field of the Invention

The present invention relates to an image forming apparatus for correcting the print position of an image on recording papers to prevent shifted print of the image.

Description of the Related Art

In this kind of image forming apparatuses, an image carrier surface is uniformly charged and scanned with a light beam, and an electrostatic latent image is formed on the image carrier surface. The electrostatic latent image on the image carrier surface is developed, forming a toner image on image carrier surface. Then, the toner image is transferred from the image carrier surface onto a recording paper, the recording paper is headed and pressed, and the toner image is fixed on the recording paper.

Here, the toner image is transferred from the image carrier surface onto the recording paper by causing the recording paper to be held at a nip area between the image carrier and a transfer roller, and if the point when the recording paper reaches the nip area shifts, the print position of the toner image on the recording paper shifts in a sheet transport direction (sub-scanning direction). Meanwhile, if the recording paper shifts in a main scanning direction perpendicular to the sheet transport direction with respect to the nip area between the image carrier and the transfer roller, the print position of the toner image on the recording paper shifts in the main scanning direction.

Therefore, a registration roller is provided on the side upstream, in the sheet transport direction, of the nip area between the image carrier and the transfer roller, to prevent shifted print of the toner image on the recording paper by adjusting with the registration roller the point when the recording paper reaches the nip area or displacing the toner image position on the image carrier in the sheet transport direction. In other cases, shifted print of the toner image on the recording paper is prevented by displacing the toner image position on the image carrier surface in the main scanning direction.

Further, shifted print of the toner image on the recording paper occurs due to various causes and is not constant. For example, in the configuration where a plurality of paper feed cassettes are provided and recording papers are fed from one of those paper feed cassettes, the print position of the toner image on the recording papers differs with respect to each paper feed cassette. Even when the same paper feed cassette is used, the print position of the toner image on the recording papers varies depending on the type (size, basis weight, or the like) of the recording papers fed from this paper feed cassette.

Conventionally, the print position of the toner image on the recording papers is measured in advance with respect to each paper feed cassette, the measured values are stored in a memory in association with the respective paper feed cassettes, and when a recording paper is fed from an arbitrary paper feed cassette, the measured value corresponding to this paper feed cassette is read out from the memory, the print position of the toner image on the recording paper is corrected in accordance with the read measured value, and the shifted print of the toner image on the recording paper is thereby prevented.

Further, in JP H8-6332A (hereinafter referred to as Patent Literature 1), an adjustment value for the print position is obtained in advance with respect to each type, thickness, or the like of recording papers, the adjustment values are stored in the memory in association with the respective types, thicknesses, or the like of recording papers, and when the toner image is printed on the recording paper, the type, thickness, or the like of this recording paper is detected, the adjustment value corresponding to the detected type, thickness, or the like of the recording paper is read out from the memory, the print position of the toner image on the recording paper is corrected based on the read adjustment value, and shifted print of the toner image on the recording paper is thereby prevented.

Further, in JP 2006-248644A (hereinafter referred to as Patent Literature 2), a sensor for detecting the leading end of recording papers is provided downstream, in the sheet transport direction, of the registration roller, the rotational speed of the registration roller is controlled in accordance with the time taken from the point when the registration roller starts transporting the recording paper to the point when the sensor detects the leading end of the recording paper to make constant the time taken for the leading end of the recording paper to reach the transfer position of the toner image from the registration roller, and shifted print of the toner image on the recording paper is thereby prevented.

However, in large-scale image forming apparatuses, the number of paper feed cassettes is large and it is not easy to measure in advance the print position of the toner image on the recording papers with respect to each paper feed cassette. Moreover, even when the same paper feed cassette is used, the print position of the toner image on the recording papers varies, and so even if the print position of the toner image on the recording papers is measured with respect to each paper feed cassette, the measured values are not very reliable. Accordingly, even if the print position of the toner image on the recording papers is corrected based on the measured value with respect to each paper feed cassette, the correction is not always appropriate.

Furthermore, it is also not easy to obtain in advance the print position adjustment value with respect to each type of recording papers as in Patent Literature 1. Moreover, as in the case where the print position of the toner image on the recording paper is corrected in accordance with the measure value with respect to each paper feed cassette, the print position of the toner image varies even on the recording papers of the same type. Accordingly, even if the adjustment value for the print position of the toner image on the recording papers is obtained with respect to each type of recording papers, those adjustment values are not very reliable. Therefore, even if the print position of the toner image on the recording paper is corrected in accordance with the adjustment value for each type of recording papers, the print position of the toner image is not always corrected appropriately.

Of course if the print positions of the toner image on a plurality of recording papers are measured with respect to the same paper feed cassette or the same type of recording papers and the average value of those measured values is obtained, the measured values or adjustment values would be more reliable. However, it is extremely difficult to perform such operation with respect to each of the plurality of the paper feed cassettes or multiple types of recording papers.

Further, even if the time taken for the leading end of recording papers to reach the transfer position of the toner image from the registration roller is made constant by controlling the rotational speed of the registration roller as in Patent Literature 2, such control of the rotational speed of the registration roller becomes difficult as the transport speed of recording papers is accelerated and the rotational speed of the registration roller is also accelerated.

SUMMARY OF THE INVENTION

The present invention was made in consideration of the above-described situation, and it is an object thereof to provide an image forming apparatus capable of appropriately correcting the print position of the toner image on the recording papers with simple setting operation, regardless of the number of paper feed cassettes or the type of recording papers.

To solve the above-described problem, the image forming apparatus according to the present invention includes: a plurality of paper feed units; a print unit for forming an image and printing the formed image on a recording paper; a registration roller, arranged between the paper feed units and the print unit, for receiving a recording paper transported from one of the paper feed units and transporting the recording paper to the print unit; a sheet leading end sensor provided downstream, in a transport direction of the recording paper, of the registration roller, for detecting a leading end of the recording paper; a time measuring unit for measuring a time from a start point of transportation of the recording paper by the registration roller to a point of detection of the leading end of the recording paper by the sheet leading end sensor; a memory unit for storing a reference image forming time, which is a reference value of a length of an image forming period from an image formation start point in the print unit to the start point of transportation of the recording paper by the registration roller and a reference time, which is a reference value of a time from the start point of transportation to the point of detection of the leading end of the recording paper by the sheet leading end sensor; a print control unit for adjusting, when a recording paper is fed from an arbitrary paper feed unit among the paper feed units, a print position of an image on the recording paper by controlling the print unit and the registration roller to adjust the length of the image forming period; and an arithmetic unit for obtaining, as a comparative time, a time detected by the time measuring unit when the leading end of the recording paper is detected by the sheet leading end sensor, and obtaining a difference between the reference time and the comparative time. In this image forming apparatus, the print control unit adjusts, when the recording paper is fed from the arbitrary paper feed unit, the length of the image forming period in accordance with an adjusted image forming time determined based on the reference image forming time and the difference obtained by the arithmetic unit before the recording paper is fed and when another recording paper was fed from the arbitrary paper feed unit.

In this invention, the reference image forming time stored in the memory unit may be a length of the image forming period predetermined with respect to recording papers fed from a reference paper feed unit among the paper feed units. Further, the reference time stored in the memory unit may be the time detected in advance by the time measuring unit with respect to recording papers fed from the reference paper feed unit among the paper feed units. In other words, the image forming apparatus may also be configured such that the control unit having the print control unit and the arithmetic unit obtains as a comparative time, when a recording paper is fed from an arbitrary paper feed unit among the paper feed units, the time detected with respect to this recording paper by the time measuring unit, obtains the difference between the comparative time and the reference time detected in advance by the time measuring unit with respect to a recording paper fed from the reference paper feed unit among the paper feed units, changes based on the difference the length (image formation timing) of the image forming period in the print unit set in advance with respect to the recording paper fed from the reference paper feed unit, and thus corrects the print position of an image on another recording paper fed from the arbitrary paper feed unit.

In the above-described present invention, regarding a recording paper fed from the reference paper feed unit, the time from a start point of transportation by the registration roller to a point of detection of the leading end of the recording paper by the sheet leading end sensor is obtained as a reference time, and the length (image formation timing) of the image forming period is set in advance as a reference image forming time. Then, regarding a recording paper fed from the arbitrary paper feed unit, the time from the start point of transportation by the registration roller to the point of detection of the leading end of the recording paper by the sheet leading end sensor is obtained as a comparative time, and the difference between the reference time and the comparative time is obtained. This difference corresponds to the position difference between the leading end of the recording paper fed from the arbitrary paper feed unit and the leading end of the recording paper fed from the reference paper feed unit, and corresponds to the amount of shift between the print position of an image before being corrected on the recording paper fed from the arbitrary paper feed unit and the print position of the image on the recording paper fed from the reference paper feed unit. Therefore, the length (image formation timing) of the image forming period set in advance is changed based on that difference, and thus the print position of the image on a recording paper fed from the arbitrary paper feed unit is appropriately corrected.

The thus corrected print position may also be obtained for any recording papers fed from the paper feed units. Accordingly, the reference time and the length (image formation timing) of the image forming period only with respect to a single paper feed unit used as a reference have to be obtained and set in advance, and the reference time and the length (image formation timing) of the image forming period with respect to other paper feed units do not have to be set in advance.

Further, the image forming apparatus according to the present invention includes: a paper feed unit; a print unit for forming an image and printing the formed image on a recording paper; a registration roller, arranged between the paper feed unit and the print unit, for receiving a recording paper transported from the paper feed unit and transporting the recording paper to the print unit; a sheet leading end sensor provided downstream, in a transport direction of the recording paper, of the registration roller, for detecting a leading end of the recording paper; a time measuring unit for measuring a time from a start point of transportation of the recording paper by the registration roller to a point of detection of the leading end of the recording paper by the sheet leading end sensor; a memory unit for storing a reference image forming time, which is a reference value of a length of an image forming period from an image formation start point in the print unit to the start point of transportation of the recording paper by the registration roller, and a reference time, which is a reference value of a time from the start point of transportation to the point of detection of the leading end of the recording paper by the sheet leading end sensor; a print control unit for adjusting, when a recording paper of an arbitrary type is fed from the paper feed unit, a print position of an image on the recording paper by controlling the print unit and the registration roller to adjust the length of the image forming period; and an arithmetic unit for obtaining, as a comparative time, a time detected by the time measuring unit when the leading end of the recording paper is detected by the sheet leading end sensor, and obtaining a difference between the reference time and the comparative time. In this image forming apparatus, the print control unit adjusts, when a recording paper of the arbitrary type is fed from the paper feed unit, the length of the image forming period in accordance with an adjusted image forming time determined based on the reference image forming time and the difference obtained by the arithmetic unit before the recording paper is fed and when another recording paper of the arbitrary type was fed from the paper feed unit.

In this invention, the reference image forming time stored in the memory unit may be the length of the image forming period predetermined with respect to recording papers of a predetermined type fed from the paper feed unit. Further, the reference time stored in the memory unit may be the time detected by the time measuring unit with respect to recording papers of a predetermined type fed from the paper feed unit. In other words, the image forming apparatus may also be configured such that the control unit having the print control unit and the arithmetic unit obtains as a comparative time, when a recording paper of an arbitrary type is fed from the paper feed unit, the time detected with respect to this recording paper by the time measuring unit, obtains a difference between the comparative time and the reference time detected by the time measuring unit with respect to a recording paper of the predetermined type fed from the paper feed unit, changes based on the difference the length (image formation timing) of the image forming period set in advance with respect to the recording paper of the predetermined type, and thus corrects the print position of an image on another recording paper of the arbitrary type.

In the above-described present invention, regarding a recording paper of the predetermined type, the time from a start point of transportation by the registration roller to a point of detection of the leading end of the recording paper by the sheet leading end sensor is obtained as a reference time, and the length (image formation timing) of the image forming period is set in advance as a reference image forming time. Then, regarding a recording paper of the arbitrary type, the time from the start point of transportation by the registration roller to the point of detection of the leading end of the recording paper by the sheet leading end sensor is obtained as a comparative time, and the difference between the reference time and the comparative time is obtained. This difference corresponds to the position difference between the leading end of the recording paper of the arbitrary type and the leading end of the recording paper of the predetermined type, and corresponds to the amount of shift between the print position of an image before being corrected on the recording paper of the arbitrary type and the print position of the image on the recording paper of the predetermined type. Therefore, the length (image formation timing) of the reference image forming period in the print unit set in advance is changed based on the above difference, and thus the print position of the image on a recording paper of the arbitrary type is appropriately corrected.

The thus corrected print position may also be obtained for any type of recording papers. Accordingly, the reference time and the length (image formation timing) of the image forming period only with respect to recording papers of the predetermined type have to be obtained and set in advance, and the reference time and the length (image formation timing) of the image forming period with respect to recording papers of other types do not have to be set in advance.

For example, in the image forming apparatus according to the present invention, the print unit may include: an image carrier; a writing unit for writing an electrostatic latent image on the image carrier; a developing unit for developing the electrostatic latent image on the image carrier into a toner image; and a transfer unit for transferring the toner image on the image carrier onto the recording paper, and the print control unit may adjust the length of the image forming period, which is a period from a start point of writing of the electrostatic latent image in a sub-scanning direction by the writing unit to the start point of transportation by the registration roller.

For example, the image forming apparatus according to the present invention may include an input operation unit operated to adjust and set the reference image forming time.

Further in the image forming apparatus according to the present invention, the print control unit may adjust, when a recording paper is fed from an arbitrary paper feed unit among the paper feed units, the length of the image forming period in accordance with an adjusted image forming time determined based on the reference image forming time and an average value of the differences obtained by the arithmetic unit before the recording paper is fed and every time another recording paper was fed from the arbitrary paper feed unit. Alternatively, the print control unit may adjust, when a recording paper of an arbitrary type is fed from the paper feed unit, the length of the image forming period in accordance with an adjusted image forming time determined based on the reference image forming time and an average value of the differences obtained by the arithmetic unit before the recording paper is fed and every time another recording paper of the arbitrary type was fed from the paper feed unit. In other words, the control unit having the print control unit and the arithmetic unit may repeatedly obtain the difference every time a recording paper is fed, average those differences, and use the average difference in the correction (adjustment) on the length (image formation timing) of the image forming period.

Here, because both the reference time and the comparative time are measured values and so contain measurement errors, the average difference is obtained to reduce the influence from such measurement errors. As a result, the length (image formation timing) of the image forming time is caused to converge, and the errors can be thus reduced.

Next, an image forming apparatus according to the present invention includes: a plurality of paper feed units; a print unit for forming an image and printing the image on a recording paper transported from one of the paper feed units; a side end sensor provided upstream, in a transport direction of the recording paper, of the print unit, for detecting a side end position of the recording paper in a main scanning direction perpendicular to the transport direction; a memory unit for storing a reference side end position, which is a reference point of the side end position detected by the side end sensor, and a reference image forming position, which is a reference point of an image forming position in the main scanning direction in the print unit; a print control unit for adjusting, when a recording paper is fed from an arbitrary paper feed unit among the paper feed units, a print position of an image on the recording paper by adjusting the image forming position in the print unit; and an arithmetic unit for obtaining, when the side end position of the recording paper is detected by the side end sensor, the detected side end position as a comparative side end position, and obtaining a difference between the reference side end position and the comparative side end position. In this image forming apparatus, the print control unit adjusts, when the recording paper is fed from the arbitrary paper feed unit, the image forming position in the print unit in accordance with an adjusted image forming position determined based on the reference image forming position and the difference obtained by the arithmetic unit before the recording paper is fed and when another recording paper was fed from the arbitrary paper feed unit.

In this invention, the reference image forming position stored in the memory unit may be the image forming position in the print unit predetermined with respect to recording papers fed from a reference paper feed unit among the paper feed units. The reference side end position stored in the memory unit may be the side end position of a recording papers fed from the reference paper feed unit among the paper feed units detected in advance by the side end sensor. In other words, the image forming apparatus may also be configured such that the control unit having the print control unit and the arithmetic unit obtains as a comparative side end position, when a recording paper is fed from an arbitrary paper feed unit among the paper feed units, the side end position of this recording paper detected by the side end sensor, obtains a difference between the comparative side end position and the reference side end position of the recording paper fed from the reference paper feed unit among the paper feed units detected in advance by the side end sensor, changes based on the difference the image forming position in the print unit set in advance with respect to the recording papers fed from the reference paper feed unit, and thus corrects the print position of an image on another recording paper fed from the arbitrary paper feed unit.

In the above-described invention, regarding a recording papers fed from the reference paper feed unit, the side end position in the main scanning position of the recording paper is obtained as a reference side end position, and the image forming position in the print unit is set in advance. Then, regarding a recording paper fed from the arbitrary paper feed unit, the side end position in the main scanning position of the recording paper is obtained as a comparative side end position, and the difference between the reference side end position and the comparative side end position is obtained. This difference corresponds to the amount of shift between the print position of an image before being corrected on the recording paper fed from the arbitrary paper feed unit and the print position of the image on the recording paper fed from the reference paper feed unit. Therefore, the image forming position in the print unit set in advance is changed based on the above difference to appropriately correct the print position of the image on the recording paper fed from the arbitrary paper feed unit.

The thus corrected print position may also be obtained for any recording papers fed from the paper feed units. Accordingly, the reference side end position and the image forming position in the print unit only of a single paper feed unit used as a reference have to be obtained and set in advance, and the reference side end position and the image forming position in the print unit of the other paper feed units do not have to be set in advance.

Further, an image forming apparatus according to the present invention includes: a paper feed unit; a print unit for forming an image and printing the image on a recording paper transported from the paper feed unit; a side end sensor provided upstream, in a transport direction of the recording paper, of the print unit, for detecting a side end position of the recording paper in a main scanning direction perpendicular to the transport direction; a memory unit for storing a reference side end position, which is a reference point of the side end position detected by the side end sensor, and a reference image forming position, which is a reference point of an image forming position in the main scanning direction in the print unit; a print control unit for adjusting, when a recording paper of an arbitrary type is fed from the paper feed unit, a print position of an image on the recording paper by adjusting the image forming position in the print unit; and an arithmetic unit for obtaining, when the side end position of the recording paper is detected by the side end sensor, the detected side end position as a comparative side end position, and obtaining a difference between the reference side end position and the comparative side end position. In this image forming apparatus, the print control unit adjusts, when a recording paper of the arbitrary type is fed from the paper feed unit, the image forming position in the print unit in accordance with an adjusted image forming position determined based on the reference image forming position and the difference obtained by the arithmetic unit before the recording paper is fed and when another recording paper of the arbitrary type was fed from the paper feed unit.

In this invention, the reference image forming position stored in the memory unit may be the image forming position in the print unit predetermined with respect to recording papers of a predetermined type fed from the paper feed unit. The reference side end position stored in the memory unit may be the side end position of a recording paper of a predetermined type fed from the paper feed unit detected in advance by the side end sensor. In other words, the image forming apparatus may also be configured such that the control unit having the print control unit and the arithmetic unit obtains as a comparative side end position, when a recording paper of an arbitrary type is fed from the paper feed unit, the side end position of this recording paper detected by the side end sensor, obtains a difference between the comparative side end position and the reference side end position of the recording paper of the predetermined type fed from paper feed unit detected in advance by the side end sensor, changes based on the difference the image forming position in the print unit set in advance with respect to recording papers of the predetermined type, and thus corrects the print position of an image on another recording paper of the arbitrary type.

In the above-described invention, regarding a recording paper of the predetermined type, the side end position in the main scanning position of the recording paper is obtained as a reference side end position, and the image forming position in the print unit is set in advance. Then, regarding a recording paper of an arbitrary type, the side end position in the main scanning position of the recording paper is obtained as a comparative side end position, and the difference between the reference side end position and the comparative side end position is obtained. This difference corresponds to the amount of shift between the print position of an image before being corrected on the recording paper of the arbitrary type and the print position of the image on the recording paper of the predetermined type. Therefore, the image forming position in the print unit set in advance is changed based on the above difference to appropriately correct the print position of the image on the recording paper of the arbitrary type.

The thus corrected print position may also be obtained for any type of recording papers. Accordingly, the reference side end position and the image forming position in the print unit only with respect to the recording paper of the predetermined type have to be obtained and set in advance, and the reference side end position and the image forming position in the print unit with respect to recording papers of other types do not have to be set in advance.

For example, in the image forming apparatus according to the present invention, the print unit may include: an image carrier; a writing unit for writing an electrostatic latent image on the image carrier; a developing unit for developing the electrostatic latent image on the image carrier into a toner image; and a transfer unit for transferring the toner image on the image carrier onto the recording paper, and the print control unit may adjust the image forming position in the print unit by adjusting, in accordance with the adjusted image forming position, a writing start position where the writing unit starts writing an electrostatic latent image in the main scanning direction.

For example, the image forming apparatus according to the present invention may also include an input operation unit operated to adjust and set the reference image forming position.

Further, in the image forming apparatus according to the present invention, the print control unit may adjust, when a recording paper is fed from an arbitrary paper feed unit among the paper feed units, the image forming position in the print unit in accordance with an adjusted image forming position determined based on the reference image forming position and an average value of the differences obtained by the arithmetic unit before the recording paper is fed and every time another recording paper was fed from the arbitrary paper feed unit. Alternatively, the print control unit may adjust, when a recording paper of an arbitrary type is fed from the paper feed unit, the image forming position in the print unit in accordance with an adjusted image forming position determined based on the reference image forming position and an average value of the differences obtained by the arithmetic unit before the recording paper is fed and every time another recording paper of the arbitrary type was fed from the paper feed unit. In other words, the control unit having the print control unit and the arithmetic unit may repeatedly obtain the difference every time a recording paper is fed, average those differences, and use the average difference in the correction (adjustment) on the print position.

Here, because both the reference side end position and the comparative side end position are measured values and so contain measurement errors, the average difference is obtained to reduce the influence from such measurement errors. As a result, the print position of an image is caused to converge, and the errors can be thus reduced.

Further, in the image forming apparatus according to the present invention, the type of the recording paper may be a type based on a size or basis weight of the recording paper.

If the size or basis weight of recording papers varies, the print position of an image on the recording papers shifts.

DESCRIPTION OF THE PREFERRED EMBODIMENT

An embodiment of the present invention will be described in detail with reference to the accompanying drawings.

Figure 1:
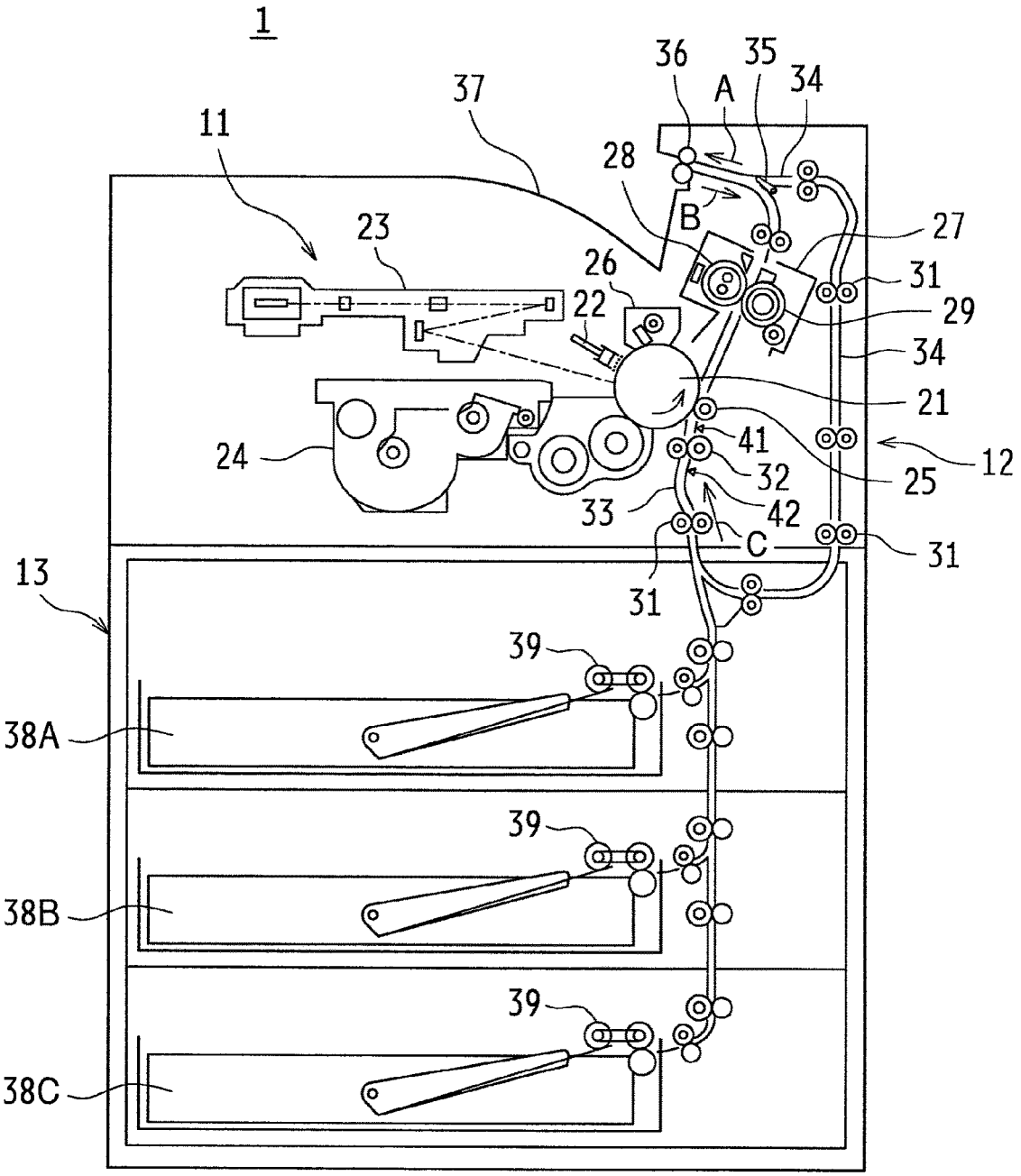
FIG. 1 is a cross-sectional view showing an embodiment of an image forming apparatus according to the present invention.

FIG. 1 is a cross-sectional view showing an embodiment of the image forming apparatus according to the present invention. An image forming apparatus 1 according to the present embodiment is designed to print a monochrome image given by image data on a recording paper, and broadly divided into a print unit 11, a sheet transport unit 12, and a paper supply unit 13.

In this image forming apparatus 1, image data is received from an external scanner, a terminal device or the like, subjected to various kinds of image processing, and input to the print unit 11, and an image given by the image data is printed on a recording paper in the print unit 11.

A photosensitive drum 21 is arranged in an approximate center of the print unit 11, and in its surroundings a charging device 22, a laser exposure device 23, a developing device 24, a transfer roller 25, and a cleaning device 26 are arranged.

The photosensitive drum 21 has a photosensitive layer on its surface. The surface of the photosensitive drum 21 is cleaned by the cleaning device 26 while the photosensitive drum 21 rotated in a direction indicated by an arrow (see FIG. 1) and then the surface of the photosensitive drum 21 is uniformly charged by the charging device 22. The charging device 22 may be of a charger type, or a roller or brush type in contact with the photosensitive drum 21. The laser exposure device 23 is a laser scanning unit (LSU) provided with a laser diode and a reflecting mirror and designed to, when image data is input, modulate the intensity of a laser beam in accordance with image data while scanning the surface of the photosensitive drum 21 with the laser beam to write an electrostatic latent image on the surface of the photosensitive drum 21. The developing device 24 develops the electrostatic latent image on the surface of the photosensitive drum 21 with a toner and forms a toner image on the surface of the photosensitive drum 21.

The transfer roller 25 is pressed against the photosensitive drum 21 to form a nip area therebetween, rotates together with the photosensitive drum 21, and, while transporting a recording paper held at the nip area, transfers the toner image on the surface of the photosensitive drum 21 onto the recording paper.

The upper part of the print unit 11 is provided with a fixing device 27. The fixing device 27 has a heating roller 28 and a pressing roller 29 that are pressed against each other, heats and presses a recording paper held at a nip area between the heating roller 28 and the pressing roller 29, and fixes the toner image transferred on the recording paper.

The sheet transport unit 12 has a plurality of transport roller pairs 31 for transporting recording papers, a registration roller pair 32, a transport path 33, an alternative path 34, a branch claw 35, a discharge roller pair 36, a discharge tray 37, and the like.

The paper supply unit 13 further includes a plurality of paper feed cassettes (paper feed units) 38A, 38B, and 38C. The paper feed cassettes 38A, 38B, and 38C are designed to contain recording papers, and provided on a plurality of stages in the lower part of the image forming apparatus 1. Each of the paper feed cassettes 38A, 38B, and 38C has a pickup roller 39 or the like for pulling out recording papers sheet by sheet, and sends out the pulled recording papers to the transport path 33 in the sheet transport unit 12.

In the transport path 33, a recording paper pulled out from any of the paper feed cassettes is transported in the sheet transport direction C and delivered to the registration roller pair 32. The leading end of the recording paper is caused to abut against the registration roller pair 32 that is temporarily stopped and thus bent such that the leading end of the recording paper is aligned parallel to the registration roller pair 32 due to the elastic force of the recording paper. Then, the registration roller pair 32 starts to rotate and transports the recording paper to the nip area between the photosensitive drum 21 and the transfer roller 25. This recording paper passes through the nip area between photosensitive drum 21 and the transfer roller 25, and the toner image is transferred onto the recording paper. It then passes through the nip area between the heating roller 28 and the pressing roller 29, and the toner image is fixed on the recording paper. It is then transported by the discharge roller pair 36 in a forward direction A and discharged to the discharge tray 37.

Further, if an image is also printed on the back face of the recording paper, the discharge roller pair 36 is stopped while the recording paper is being transported in the forward direction A and discharged to the discharge tray 37. In other words, the discharge roller pair 36 is stopped in a state where the recording paper is held between the rollers. The branch claw 35 is shifted obliquely downward, and the discharge roller pair 36 is then rotated in a reverse direction to transport the recording paper in a reverse direction B and leads it to the alternative path 34, and then the recording paper is again led to the transport path 33 through the alternative path 34 and returned to the registration roller pair 32.

Such shifting of the transport direction of recording papers is referred to as "switch-back transport," with which a recording paper is turned over and simultaneously its leading end and back end are switched. Accordingly, when the turned recording paper is returned, the back end of the recording paper is caused to abut against the registration roller pair 32 and aligned parallel to the registration roller pair 32. The recording paper is transported from its back end by the registration roller pair 32 to the nip area between the photosensitive drum 21 and the transfer roller 25, the toner image is printed on the back face of the recording paper, the toner image is fixed on the back face of the recording paper by the heating roller 28 and the pressing roller 29, and the recording paper is discharged to the discharge tray 37 through the discharge roller pair 36.

In the image forming apparatus 1, the print position of a toner image on recording papers shifts due to various reasons. Therefore, in this embodiment, a sheet leading end sensor 41 for detecting the leading end of recording papers is provided downstream, in the sheet transport direction C (sub-scanning direction), of the registration roller pair 32. The time from the point when the registration roller pair 32 starts transporting a recording paper to the point when the sheet leading end sensor 41 detects the leading end of the recording paper is obtained, and the print position of the toner image in the sheet transport direction C on the recording paper is adjusted (corrected) using the obtained time. Further, a line sensor 42 (a side end sensor) for detecting the side end of recording papers is provided upstream, in the sheet transport direction C, of the registration roller pair 32, and the print position of a toner image in the main scanning direction on a recording paper is adjusted (corrected) using the side end position in the main scanning direction of the recording paper detected by the line sensor 42.

Further, providing the plurality of the paper feed cassettes 38A, 38B, and 38C is one of the reasons the print position of a toner image on recording papers shifts, and the print position of the toner image on recording papers varies depending on the paper feed cassette from which this recording paper is fed. For example, with respect to each of the paper feed cassettes 38A, 38B, and 38C, the end position of recording papers when being caused to abut against the registration roller pair 32 varies, or the side end position in the main scanning direction of recording papers varies. For that reason the print position of a toner image on the recording papers varies. Therefore, the print position of the toner image on recording papers is adjusted (corrected) with respect to each of the paper feed cassettes 38A, 38B, and 38C.

Figure 2A:
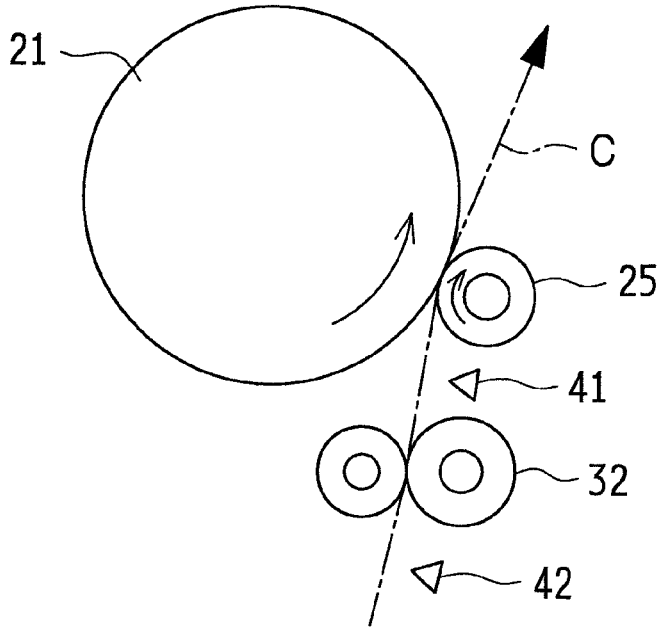
FIG. 2A is an enlarged side view showing an arrangement of a registration roller pair, a sheet leading end sensor, and a line sensor in the image forming apparatus shown in FIG. 1.
Figure 2B:
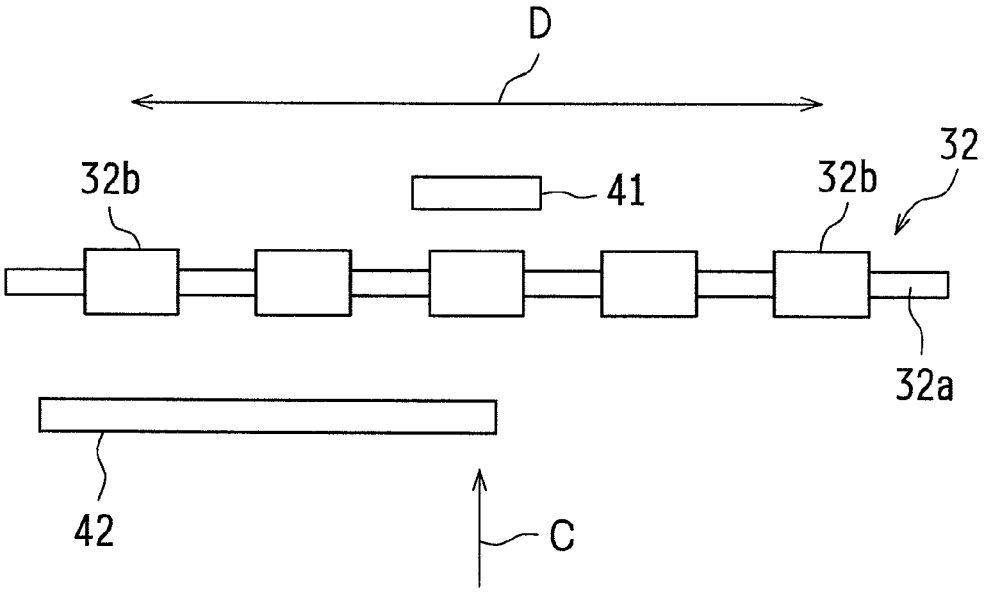
FIG. 2B is an enlarged plan view showing the arrangement of the registration roller pair, the sheet leading end sensor, and the line sensor in the image forming apparatus shown in FIG. 1.

Next, the configuration for performing the above-mentioned adjustment (correction) to the print position of a toner image on recording papers is described. FIGS. 2A and 2B are an enlarged side view and plan view, respectively, showing the arrangement of the registration roller pair 32, the sheet leading end sensor 41, and the line sensor 42. As shown in FIGS. 2A and 2B, the sheet leading end sensor 41 is arranged downstream, in the sheet transport direction C, of the registration roller pair 32, the photosensitive drum 21 and the transfer roller 25 are arranged downstream, in the sheet transport direction C, of the sheet leading end sensor 41, and the line sensor 42 is arranged upstream, in the sheet transport direction C, of the registration roller pair 32.

Here, the registration roller pair 32 is formed by passing a shaft 32*a* through a plurality of short rollers 32*b* and securing those short rollers 32*b*, and also passing the other shaft 32*a* through a plurality of short rollers 32*b* and securing those short rollers 32*b*, and causing the short rollers 32*b* on the shaft 32*a* and the corresponding short rollers 32*b* on the other shaft 32*a* to press against each other. The leading end of a recording paper transported from the transport roller pair 31 is caused to abut against the registration roller pair 32 in a state where the registration roller pair 32 is temporarily stopped, the leading end of the recording paper is aligned parallel to the registration roller pair 32, and after that the registration roller pair 32 starts transporting the recording paper and transports this recording paper to the nip area between the photosensitive drum 21 and the transfer roller 25.

The sheet leading end sensor 41 is located downstream, in the sheet transport direction C, of the nip area of the registration roller pair 32 at a specific distance therefrom, and at a middle position in the longitudinal direction (a main scanning direction D perpendicular to the sheet transport direction C) of the registration roller pair 32. The sheet leading end sensor 41 is, for example, an optical sensor having a light-emitting element and a light-receiving element, and designed to output light from the light-emitting element towards the transport path 33 for recording papers, receive with the light-receiving element reflected light from a recording paper that is being transported along the transport path 33, and detect the leading end of the recording paper based on output variation of the light-receiving element.

The line sensor 42 has a length of, for example, half the maximum width of recording papers or longer to be able to detect the side end position of recording papers of the minimum to maximum widths, and is located so as to cover from one side end to the center of recording papers of the maximum width transported along the transport path 33. This line sensor 42 is, for example, a contact image sensor (hereinafter abbreviated as CIS), which includes a light source for outputting a linear light beam in the main scanning direction D towards the transport path 33 and a plurality of light-receiving elements arranged in the main scanning direction D for receiving a reflected light beam from recording papers in the transport path 33. The line sensor 42 is designed to detect, as the side end position of a recording paper, the position between the light-receiving element that receives the reflected light beam from the recording paper in the transport path 33 and the light-receiving element that does not receive the reflected light.

The line sensor 42 may be the one having a length equal to or larger than the maximum width of recording papers and capable of detecting both end positions of the recording papers. Other types of the line sensor 42 are also applicable. Furthermore, the line sensor 42 may alternatively be arranged downstream, in the sheet transport direction C, of the nip area of the registration roller pair 32.

Figure 3:
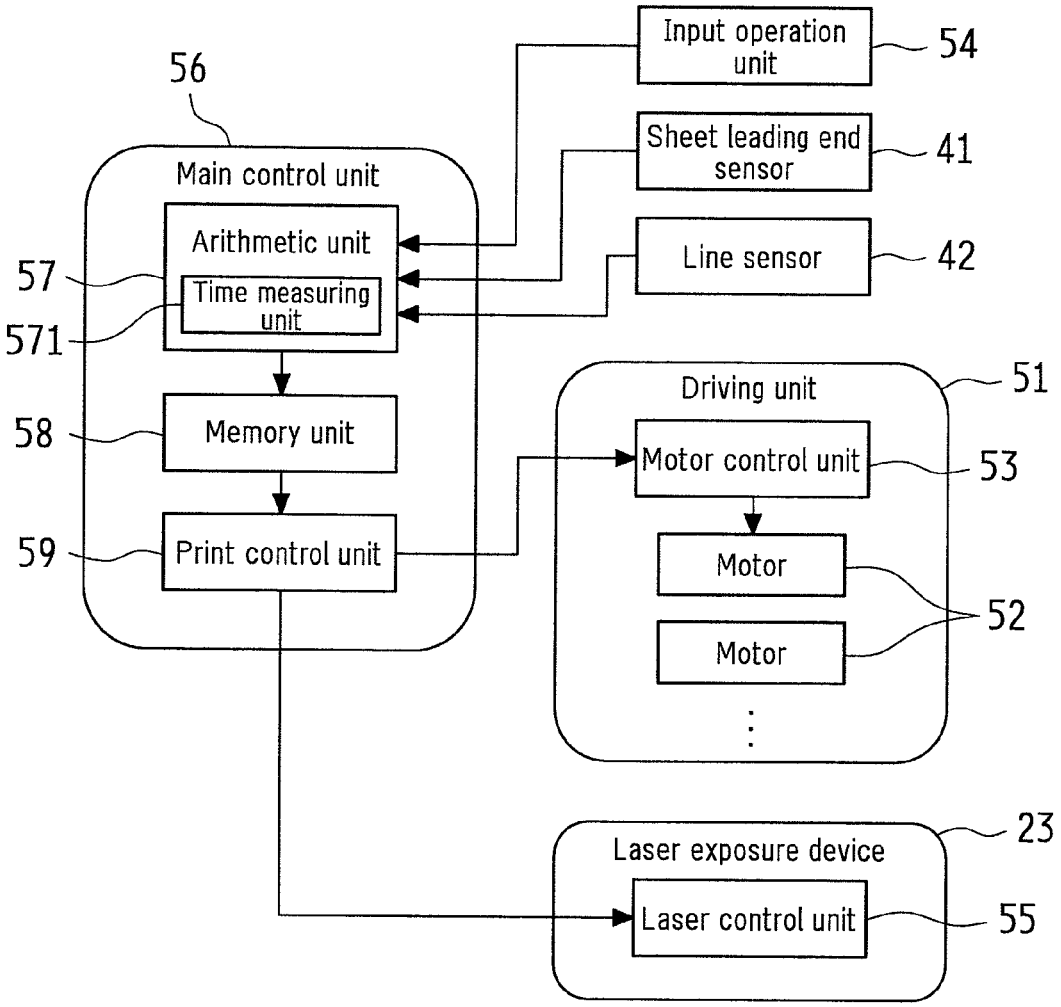
FIG. 3 is a block diagram showing a configuration of a control system related to correction on a print position of a toner image on a recording paper in the image forming apparatus shown in FIG. 1.

FIG. 3 is a block diagram showing a configuration of the control system related to the correction on the print position of a toner image on recording papers. Referring to FIG. 3, a driving unit 51 has motors 52 for driving the transport roller pair 31, the registration roller pair 32, the discharge roller pair 36, and the pickup roller 39; and a motor control unit 53 for controlling driving of each motor 52. An input operation unit 54 has a display screen, a plurality of operation keys, and the like, and displays operation guidance for the image forming apparatus 1 on the display screen and makes available input operations using the operation keys. A laser control unit 55 is designed to control driving of the laser exposure device 23 for writing, with a laser beam, an electrostatic latent image on the surface of the photosensitive drum 21, and control the point to start writing with a laser beam an electrostatic latent image on the surface of the photosensitive drum 21 in a sub-scanning direction, the writing start position in the main scanning direction, and the like. A main control unit 56 has an arithmetic unit 57 for performing arithmetic processing to obtain the print position of a toner image on recording papers based on detection outputs from the sheet leading end sensor 41 and the line sensor 42; a memory unit 58 for storing various types of data obtained by the arithmetic unit 57; and a print control unit 59 for controlling each motor 52 via the motor control unit 53 to rotate or stop the transport roller pair 31, the registration roller pair 32, the discharge roller pair 36, and the pickup roller 39, and controlling the laser exposure device 23 via the laser control unit 55. The arithmetic unit 57 includes a time measuring unit 571 for measuring a time from a start point of transportation of the recording paper by the registration roller pair 32 to a point of detection of the leading end of the recording paper by the sheet leading end sensor 41.

With this configuration, the correction on the print position of a toner image in the sheet transport direction C on recording papers is performed as described below.

First, as already described, the print position of a toner image on recording papers varies depending on the paper feed cassette 38A, 38B, or 38C from which the recording paper is fed. For example, as shown in the timing chart in FIG. 4, it is assumed that at point t1 writing of an electrostatic latent image with a laser beam on the surface of the photosensitive drum 21 is started (i.e., image formation is started), the electrostatic latent image on the surface of the photosensitive drum 21 is developed, a toner image is formed on the surface of the photosensitive drum 21, and at point t4 the toner image on the surface of the photosensitive drum 21 reaches the nip area between the photosensitive drum 21 and the transfer roller 25. In this case, prior to point t2 the leading end of the recording paper reaches the registration roller pair 32, at point t2 the registration roller pair 32 starts transporting the recording paper, at point t4 the leading end of the recording paper reaches the nip area between the photosensitive drum 21 and the transfer roller 25, the toner image on the surface of the photosensitive drum 21 is transferred onto the recording paper in this nip area, and the toner image is printed at an appropriate position on the recording paper. In other words, if the point when the leading end of the recording paper reaches the nip area between the photosensitive drum 21 and the transfer roller 25 coincides with point t4 when the toner image on the surface of the photosensitive drum 21 reaches the nip area between the photosensitive drum 21 and the transfer roller 25, the print position of the toner image on the recording paper does not shift, and the toner image is printed at an appropriate position on the recording paper. However, the point when the leading end of the recording paper reaches the nip area between the photosensitive drum 21 and the transfer roller 25 varies depending on the paper feed cassette 38A, 38B, or 38C from which the recording paper is fed, and if this point does not coincide with point t4 when the toner image on the surface of the photosensitive drum 21 reaches the nip area between the photosensitive drum 21 and the transfer roller 25, the print position of the toner image on the recording paper shifts.

Therefore, in this embodiment, the paper feed cassette 38A is preset to a reference paper feed cassette at the time of, for example, inspection of the image forming apparatus 1 before being shipped from the factory. The print position of a toner image in the sheet transport direction C on a recording paper fed from this reference paper feed cassette 38A is adjusted as appropriate, the length of an image forming period from point t1 to point t2 at this time is obtained, and the obtained length of the image forming period is set to a reference image forming time ΔT (image forming timing, see FIG. 4). Further, regarding the recording paper fed from the reference paper feed cassette 38A, the time from point t2 when the registration roller pair 32 starts transporting to point t3 when the sheet leading end sensor 41 detects the leading end of the recording paper is obtained, and the obtained time is set to a reference time Δt11 (see FIG. 4). The reference image forming time ΔT and the reference time Δt11 obtained as above are stored in the memory unit 58.

Figure 4:
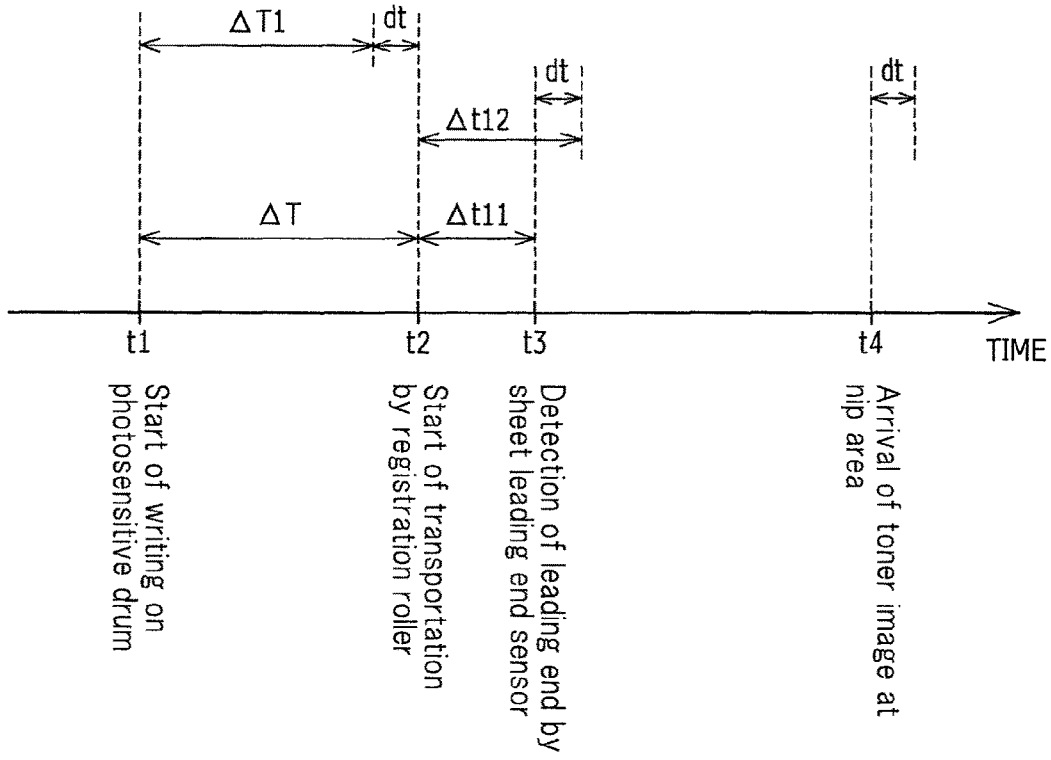
FIG. 4 is a timing chart showing the point of starting to write an electrostatic latent image on a photosensitive drum, the point of starting to transport a recording paper by the registration roller pair, and the point of starting to transfer a toner image, and so on in the image forming apparatus shown in FIG. 1.

Then, when the image forming apparatus 1 is used by a user, regarding a recording paper fed from an arbitrary paper feed cassette among the paper feed cassettes 38A, 38B, and 38C, the time Δt12 from point t2 when the registration roller pair 32 starts transporting to point t3 when the sheet leading end sensor 41 detects the leading end of the recording paper is obtained as a comparative time, and a difference dt between the reference time Δt11 and the comparative time Δt12 is obtained (see FIG. 4). After that, if the image print processing on the recording papers fed from the same paper feed cassette is continued, the reference image forming time ΔT is corrected by the difference dt, an adjusted image forming time ΔT1 (ΔT1=ΔT−dt) is obtained, and the obtained adjusted image forming time ΔT1 is set to the length of the image forming period (i.e., the period from when writing of the electrostatic latent image on the surface of the photosensitive drum 21 in the sub-scanning direction is started to when the registration roller pair 32 starts transporting) in this print processing. More specifically, point t1 when writing of the electrostatic latent image on the surface of the photosensitive drum 21 in the sub-scanning direction is started or point t2 when the registration roller pair 32 starts transporting a recording paper is changed by the difference dt.

Here, the leading end of a recording paper fed from the arbitrary paper feed cassette is, after reaching the sheet leading end sensor 41, subsequently transported at a fixed transporting speed from the sheet leading end sensor 41 until reaching the nip area between the photosensitive drum 21 and the transfer roller 25, and this transporting speed is approximately unchanged regardless of the paper feed cassette from which the recording paper is fed. Accordingly, the difference dt approximately coincides with the time difference between the point when the leading end of a recording paper fed from the arbitrary paper feed cassette reaches the nip area and the point when the leading end of the recording paper fed from the reference paper feed cassette 38A reaches the nip area, and corresponds to the difference between the uncorrected print position of the toner image in the sheet transport direction C on the recording paper fed from the arbitrary paper feed cassette and the print position of the toner image in the sheet transport direction C on the recording paper fed from the reference paper feed cassette 38A.

Further, when the length of the image forming period from point t1 to point t2 is changed from the reference image forming time ΔT to the adjusted image forming time ΔT1, the point when the leading end of the recording paper reaches the nip area is changed by the amount of the change in the length of the image forming period (i.e., the difference between the reference image forming time ΔT and the adjusted image forming time ΔT1), and the print position of the toner image on the recording paper is changed.

Therefore, by changing the reference image forming time ΔT by the difference dt between the reference time Δt11 and the comparative time Δt12 to obtain the adjusted image forming time ΔT1 (ΔT1=ΔT−dt) and adjusting the length of the image forming period such that the length of the image forming period from point t1 to point t2 is equal to the adjusted image forming time ΔT1, for example, advancing or delaying point t2 when the registration roller pair 32 starts transporting, the leading end of the recording paper fed from the arbitrary paper feed cassette is caused to reach the nip area between the photosensitive drum 21 and the transfer roller 25 at point t4, and the print position of the toner image on this recording paper is appropriately corrected.

Figure 5:
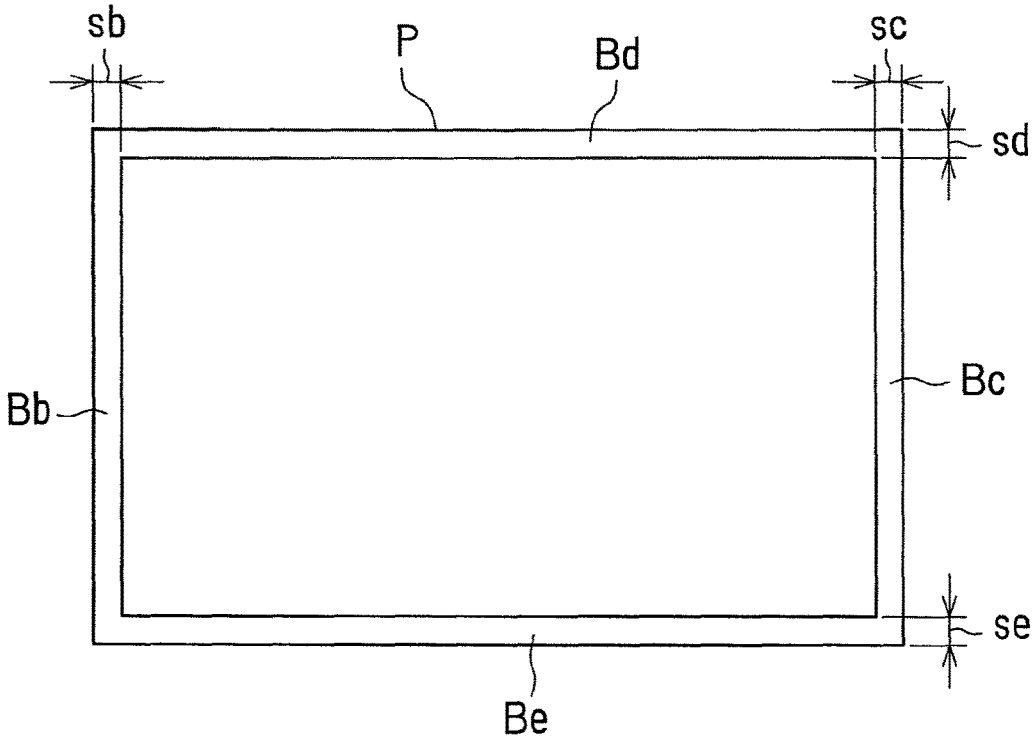
FIG. 5 is a plan view showing margins set in four sides of a recording paper.

Next, the specific process of correction on the print position of a toner image in the sheet transport direction C on recording papers is described. When the image forming apparatus 1 is inspected before being shipped from the factory, as shown in FIG. 5, void adjustment for setting the width sb of a margin area Bb at the leading end of the recording paper P and the width sc of a margin area Bc at its back end is performed, and a toner image is transferred and printed inside the margin areas Bb and Bc. Accordingly, the print position in the sheet transport direction C can be adjusted by adjusting the widths sb and sc in the margin areas Bb and Bc, respectively.

The setting process of the print position of a toner image in the sheet transport direction C on recording papers with this void adjustment is described with reference to the flowchart in FIG. 6.

First, a recording paper is fed from the reference paper feed cassette 38A to the nip area between the photosensitive drum 21 and the transfer roller 25. At this time, an electrostatic latent image of a test pattern is formed by the laser exposure device 23 on the surface of the photosensitive drum 21; the electrostatic latent image on the surface of the photosensitive drum 21 is developed by the developing device 24; a toner image of the test pattern is formed on the surface of the photosensitive drum 21; the recording paper is caused to be held at the nip area between the photosensitive drum 21 and the transfer roller 25; the toner image of the test pattern is transferred from the photosensitive drum 21 onto the recording paper, and the toner image of the test pattern on the recording paper is fixed by the fixing device 27 (step S101). In this process, the print control unit 59 controls the laser exposure device 23 via the laser control unit 55 to start, after writing of the electrostatic latent image with a laser beam onto the surface of the photosensitive drum 21 is started, measuring the time from writing start point t1, then controls, via the motor control unit 53, driving of the motor 52 for driving the registration roller pair 32 at the point when the measured time reaches the reference image forming time ΔT (initial value) stored in the memory unit 58, and causes the registration roller pair 32 to start transporting the recording paper. Further, the time from point t2 when the registration roller pair 32 starts transporting to point t3 when the sheet leading end sensor 41 detects the leading end of the recording paper is measured by the time measuring unit 571, and the measured time is temporarily set as a reference time Δt11 and stored in the memory unit 58 (step S102).

Then, an operator measures the widths sb and sc of the margin areas Bb and Bc in the recording paper P shown in FIG. 5, and checks whether or not the difference between the widths sb and sc of the margin areas Bb and Bc and predetermined widths is an acceptable value or smaller.

If the difference between the widths sb and sc of the margin area Bb and Bc and the predetermined widths is not the acceptable value or smaller, the print position in the sheet transport direction C is shifted. Therefore the widths sb and sc of the margin areas Bb and Bc are changed to adjust the print position. The amount of the change in the widths sb and sc of the margin areas Bb and Bc can be instructed by operating the input operation unit 54 (step S103).

The arithmetic unit 57 in the main control unit 56 changes the reference image forming time ΔT (initial value) by the time in accordance with the amount of the change in the widths sb and sc of the margin areas Bb and Bc, and this reference image forming time ΔT is temporarily set and stored in the memory unit 58 (step S104).

After that, the arithmetic unit 57 determines whether or not the amount of the change in the widths sb and sc of the margin areas Bb and Bc is a certain value or smaller (step S105), and the processing returns to step S101 if the amount of the change is not the certain value or smaller ("NO" at step S105).

In this case, the print control unit 59 controls the laser exposure device 23 via the laser control unit 55 to start, after writing of the electrostatic latent image with a laser beam onto the surface of the photosensitive drum 21 is started, measuring the time from writing start point t1, then controls, via the motor control unit 53, driving of the motor 52 for driving the registration roller pair 32 when the measured time reaches the reference image forming time ΔT (the reference image forming time ΔT temporarily set at step S104 in the first session of processing) stored in the memory unit 58, and causes the registration roller pair 32 to start transporting the recording paper. With the above-described process, the point when the leading end of the recording paper reaches the nip area between the photosensitive drum 21 and the transfer roller 25 is changed and the widths sb and sc of the margin areas Bb and Bc are adjusted, and the print position in the sheet transport direction C is changed (step S101). Further, the time from point t2 when the registration roller pair 32 starts transporting to point t3 when the sheet leading end sensor 41 detects the leading end of the recording paper is measured by the time measuring unit 571, and the measured time is stored as a reference time Δt11 in the memory unit 58, thereby updating the temporarily set reference time Δt11 (step S102).

Then, the operator measures the widths sb and sc of the margin areas Bb and Bc in the recording paper P, and checks whether or not the difference between the widths sb and sc of the margin areas Bb and Bc and predetermined widths is an acceptable value or smaller.

If the difference between the widths sb and sc of the margin areas Bb and Bc and predetermined widths is not the acceptable value or smaller, the amount of further change in the widths sb and sc of the margin areas Bb and Bc is instructed by operating the input operation unit 54 (step S103), and the widths sb and sc of the margin areas Bb and Bc are changed again to re-adjust the print position.

The arithmetic unit 57 in the main control unit 56 updates, in accordance with the amount of the further change in the widths sb and sc of the margin areas Bb and Bc instructed from the input operation unit 54, the reference image forming time ΔT stored in the memory unit 58 (step S104).

After that, the arithmetic unit 57 determines whether or not the amount of the further change in the widths sb and sc of the margin areas Bb and Bc is a certain value or smaller (step S105). If the amount of change is not the certain amount or smaller ("No" at step S105), the processing returns again to step S101.

Figure 6:
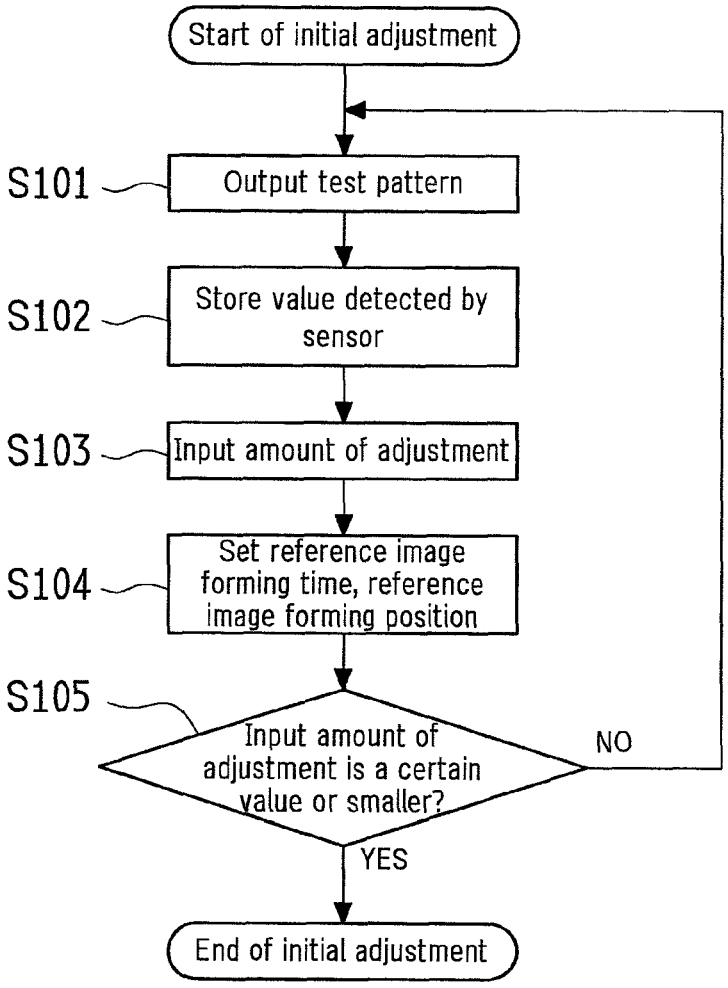
FIG. 6 is a flowchart showing a process for setting in advance a print position of a toner image on a recording paper and the like in the image forming apparatus shown in FIG. 1.

Meanwhile, if the amount of the change is the certain value or smaller ("Yes" at step S105), the reference time Δt11 and the reference image forming time ΔT stored in the memory unit 58 are determined and the processing of the flowchart in FIG. 6 ends. The determined reference time Δt11 and reference image forming time ΔT are used in the position adjustment in the sheet transport direction to recording papers fed from any of the paper feed cassettes 38A, 38B, and 38C.

Steps S101 to 105 are repeated until the amount of the change in the widths sb and sc of the margin areas Bb and Bc becomes equal to or smaller than the certain amount for the purpose of checking the widths sb and sc of the margin areas Bb and Bc and improving the accuracy of the reference time Δt11 and the reference image forming time ΔT.

Next, when the image forming apparatus 1 is used by a user, an arbitrary paper feed cassette among the paper feed cassettes 38A, 38B, and 38C is designated by operating the input operation unit 54, and the print control unit 59 in the main control unit 56 controls, via the motor control unit 53, the motor 52 for driving the pickup roller 39 and the like in the designated paper feed cassette to feed a recording paper from that paper feed cassette. Then, the print control unit 59 controls the laser exposure device 23 via the laser control unit 55 to start writing an electrostatic latent image with a laser beam on the surface of the photosensitive drum 21, starts measuring the time from writing start point t1, controls via the motor control unit 53 driving of the motor 52 for driving the registration roller pair 32 when the measured time reaches the reference image forming time ΔT stored in the memory unit 58, causes the registration roller pair 32 to start transporting the recording paper, leads the recording paper to the nip area between photosensitive drum 21 and the transfer roller 25, and transfers the toner image on the recording paper. The arithmetic unit 57, regarding the recording papers fed from the designated paper feed cassette, obtains, as a comparative time, the time Δt12 from point t2 when the registration roller pair 32 starts transporting to point t3 when the sheet leading end sensor 41 detects the leading end of the recording paper (i.e., the time detected by the time measuring unit 571), obtains a difference dt between this comparative time Δt12 and the reference time Δt11 stored in the memory unit 58, subtracts the difference dt from the reference image forming time ΔT (image forming timing) stored in the memory unit 58 to obtain an adjusted image forming time ΔT1 (image forming timing), and stores this adjusted image forming time ΔT1 in the memory unit 58 in association with the designated paper feed cassette.

After that, in the case where the print processing using the print unit 11 is continued by feeding a new recording paper from the paper feed cassette of which the adjusted image forming time ΔT has been stored in the memory unit 58 or performing the above-mentioned switch-back transport, the print control unit 59 controls the laser exposure device 23 via the laser control unit 55 to start writing an electrostatic latent image with a laser beam onto the surface of the photosensitive drum 21; starts measuring the time from writing start point t1; controls via the motor control unit 53 driving of the motor 52 for driving the registration roller pair 32 when the measured time reaches the adjusted image forming time ΔT1 stored in the memory unit 58, e.g., when the measured time reaches the point (t2-difference dt) as shown in FIG. 4; causes the registration roller pair 32 to start transporting the recording paper; leads the recording paper towards the nip area between photosensitive drum 21 and the transfer roller 25; and transfers a toner image onto the recording paper. In other words, point t2 when the registration roller pair 32 starts transporting is advanced by the difference dt based on the adjusted image forming time ΔT1. With this configuration, the leading end of the recording paper fed from an arbitrary paper feed cassette reaches the nip area between the photosensitive drum 21 and the transfer roller 25 at point t4, and the toner image is printed at an appropriate print position on the recording paper.

However, as is obvious from the timing chart in FIG. 4, regarding a recording paper fed from an arbitrary paper feed cassette, when the difference dt between the comparative time Δt12 and the reference time Δt11 stored in the memory unit 58 is obtained and the adjusted image forming time ΔT1 is obtained by subtracting the difference dt from the reference image forming time ΔT stored in the memory unit 58, the registration roller pair 32 has already started transporting this recording paper, and accordingly the point when the registration roller pair 32 starts transporting this recording paper cannot be adjusted. Therefore, when a recording paper is fed from the arbitrary paper feed cassette, the point when the registration roller pair 32 starts transporting this recording paper is adjusted based on the adjusted image forming time ΔT1 obtained with respect to a recording paper that was fed previously from the same paper feed cassette and stored in the memory unit 58 (i.e., the adjusted image forming time ΔT1 determined based on the reference image forming time ΔT and the difference obtained by the arithmetic unit 57 before the recording paper is fed from the arbitrary paper feed cassette and when another recording paper was fed from the same paper feed cassette), and the length of the image forming period from writing start point t1 to transport start point t2 is thus adjusted. If the adjusted image forming time ΔT obtained with respect to the recording paper that was fed previously from the same paper feed cassette is not stored in the memory unit 58, for example, when a recording paper is fed from a paper feed cassette that is designated for the first time, the point when the registration roller pair 32 starts transporting the recording paper is adjusted based on the reference image forming time ΔT stored in the memory unit 58.

Here, as long as recording papers are fed from the same paper feed cassette, variation in the comparative time Δt12 from point t2 when the registration roller pair 32 starts transporting to point t3 when the sheet leading end sensor 41 detects the leading end of the recording paper is small even if a number of the recording papers are fed. Therefore, the print position of a toner image on a recording paper can be appropriately corrected also by obtaining the comparative time Δt12 and the adjusted image forming time ΔT1 with respect to the previous recording paper and adjusting the point when the registration roller pair 32 starts transporting the next recording paper based on the previous adjusted image forming time ΔT1. Further, even if the rotation speed of the registration roller pair 32 is accelerated, it only adjusts the point when the registration roller pair 32 starts transporting the recording paper, and therefore appropriate correction can be performed.

The correction on the print position of a toner image in the sheet transport direction C is performed on all paper feed cassettes 38A, 38B, and 38C, and it is therefore necessary to obtain the comparative time Δt12, the difference dt between the reference time Δt11 and the comparative time Δt12, and the adjusted image forming time ΔT1 with respect to each of the paper feed cassettes 38A, 38B, and 38C.

Meanwhile, as described above, an error occurs in the comparative time Δt12 even if variation in the comparative time Δt12 is small, and a similar error is also contained in the reference time Δt11. The main cause of this error is considered to be backlashes of a group of gears that transmit rotation to the registration roller pair 32 that intermittently rotates.

Accordingly, even if during the inspection of the image forming apparatus 1 before being shipped from the factory, the print position of a toner image in the sheet transport direction C on a recording paper fed from the reference paper feed cassette 38A is adjusted, the reference image forming time ΔT is set, and the reference time Δt11 from point t2 when the registration roller pair 32 starts transporting to point t3 when the sheet leading end sensor 41 detects the leading end of the recording paper is obtained, an error is contained in the reference time Δt11 and also in the reference image forming time ΔT. In other words, it cannot be determined whether or not the reference image forming time and the reference time are true times, which do not contain any error.

Therefore, it is desirable to repeatedly obtain, every time a recording paper is fed from the same paper feed cassette, the comparative time Δt12 and the difference dt between the reference time Δt11 and the comparative time Δt12, average the differences dt, and obtain the adjusted image forming time ΔT1 by subtracting the average difference/dt from the reference image forming time ΔT.

Here, even if an error is contained in the reference time Δt11 and the comparative time Δt12, the difference dt between the reference time Δt11 and the comparative time Δt12 is repeatedly obtained and the differences dt are averaged, and then the average difference/dt converges into the difference between the reference time Δt11 and a true reference time that does not contain any error. Accordingly, the print position of a toner image on recording papers is corrected by subtracting the average difference/dt from the reference image forming time ΔT and obtaining the adjusted image forming time ΔT1, and thus the print position of the toner image on the recording papers converges into the most appropriate print position on the recording papers.

More specifically, every time a recording paper is fed from the same paper feed cassette, the arithmetic unit 57 obtains, as a comparative time, the time Δt12 from point t2 when the registration roller pair 32 starts transporting to point t3 when the sheet leading end sensor 41 detects the leading end of the recording paper (i.e., the time detected by the time measuring unit 571), obtains the difference dt between this comparative time Δt12 and the reference time Δt11 stored in the memory unit 58, and stores this difference dt in the memory unit 58 in association with the paper feed cassette from which the above recording paper is fed. Then, the arithmetic unit 57 reads out from the memory unit 58 all differences dt repeatedly obtained (and associated with the paper feed cassette from which the recording paper is fed) every time a recording paper is fed from the same paper feed cassette recording paper, obtains an average value of those differences dt, subtracts the average value of the differences dt from the reference image forming time ΔT, thereby obtaining an adjusted image forming time ΔT1, and stores this adjusted image forming time ΔT1 in the memory unit 58 in association with the paper feed cassette from which the recording paper is fed.

Meanwhile, the print control unit 59 starts measuring the time from point t1 when writing of an electrostatic latent image with a laser beam on the surface of the photosensitive drum 21 is started. When the measured time reaches the adjusted image forming time ΔT1 stored in the memory unit 58 (more specifically, the adjusted image forming time ΔT1 stored in association with the paper feed cassette from which the recording paper is fed), the print control unit 59 causes the registration roller pair 32 to start transporting the recording paper, leads the recording paper to the nip area between the photosensitive drum 21 and the transfer roller 25, and transfers the toner image on the recording paper. Thus the print position of the toner image on the recording paper is made closer to the most appropriate print position. In other words, the print control unit 59 adjusts, when a current recording paper is fed from an arbitrary paper feed cassette among the paper feed cassettes 38A, 38B, and 38C, the length of the image forming period in accordance with the adjusted image forming time ΔT1 determined based on the reference image forming time ΔT and the average value/dt of the differences dt obtained by the arithmetic unit 57 before the current recording paper is fed every time a recording paper was fed from the same paper feed cassette, thereby making the print position of a toner image on the recording papers closer to the most appropriate print position.

As described above, in the correction on the print position of a toner image in the sheet transport direction C on a recording paper, when the image forming apparatus 1 is inspected before being shipped from the factory, the print position of the toner image in the sheet transport direction C on a recording paper fed from the reference paper feed cassette 38A is adjusted, the reference image forming time ΔT is set, and the reference time Δt11 from point t2 when the registration roller pair 32 starts transporting to point t3 when the sheet leading end sensor 41 detects the leading end of the recording paper is obtained. Then, when the image forming apparatus 1 is used by a user, regarding a recording paper fed from an arbitrary paper feed cassette among the paper feed cassettes 38A, 38B, and 38C, the time Δt12 from point t2 when the registration roller pair 32 starts transporting to point t3 when the sheet leading end sensor 41 detects the leading end of the recording paper is obtained as the comparative time, the reference image forming time ΔT is corrected based on the difference dt between the reference time Δt11 and the comparative time Δt12, and thus the adjusted image forming time ΔT1 for setting an appropriate print position of the toner image on the recording paper fed from the arbitrary paper feed cassette is obtained.

Therefore, when the image forming apparatus 1 is inspected before being shipped from the factory, the reference image forming time ΔT and the reference time Δt11 only with respect to the reference paper feed cassette 38A have to be set, and so the adjustment and settings are simple.

Further, every time a recording paper is fed from the same paper feed cassette, the difference dt between the reference time Δt11 and the comparative time Δt12 is repeatedly obtained, those differences dt are averaged, the average value/dt of the differences dt is subtracted from the reference image forming time ΔT, thereby obtaining the adjusted image forming time ΔT1, and thus the print position of the toner image on the recording papers converges into the most appropriate print position.

The average value/dt may also be updated only when the difference dt between the reference time Δt11 and the comparative time Δt12 is a certain value or smaller. Thus the influence from irregular comparative times Δt12 caused by erroneous detection by the sheet leading end sensor 41 can be eliminated. Further, to save the capacity of the memory unit 58, the number of stored differences dt may be limited and oldest differences dt may be sequentially deleted. Further, the average value/dt and the number k of differences dt used to obtain the average value/dt may be stored, and the average value/dt may be updated based on the newly obtained difference dt, the average value/dt, and the number k.

Next, the correction on the print position of a toner image in the main scanning direction D on recording papers is described in detail. The print position in the main scanning direction D also varies depending on the paper feed cassette 38A, 38B, or 38C from which a recording paper is fed. This is caused by difference in the set position of recording papers in the respective paper feed cassettes 38A, 38B, and 38C.

Figure 7:
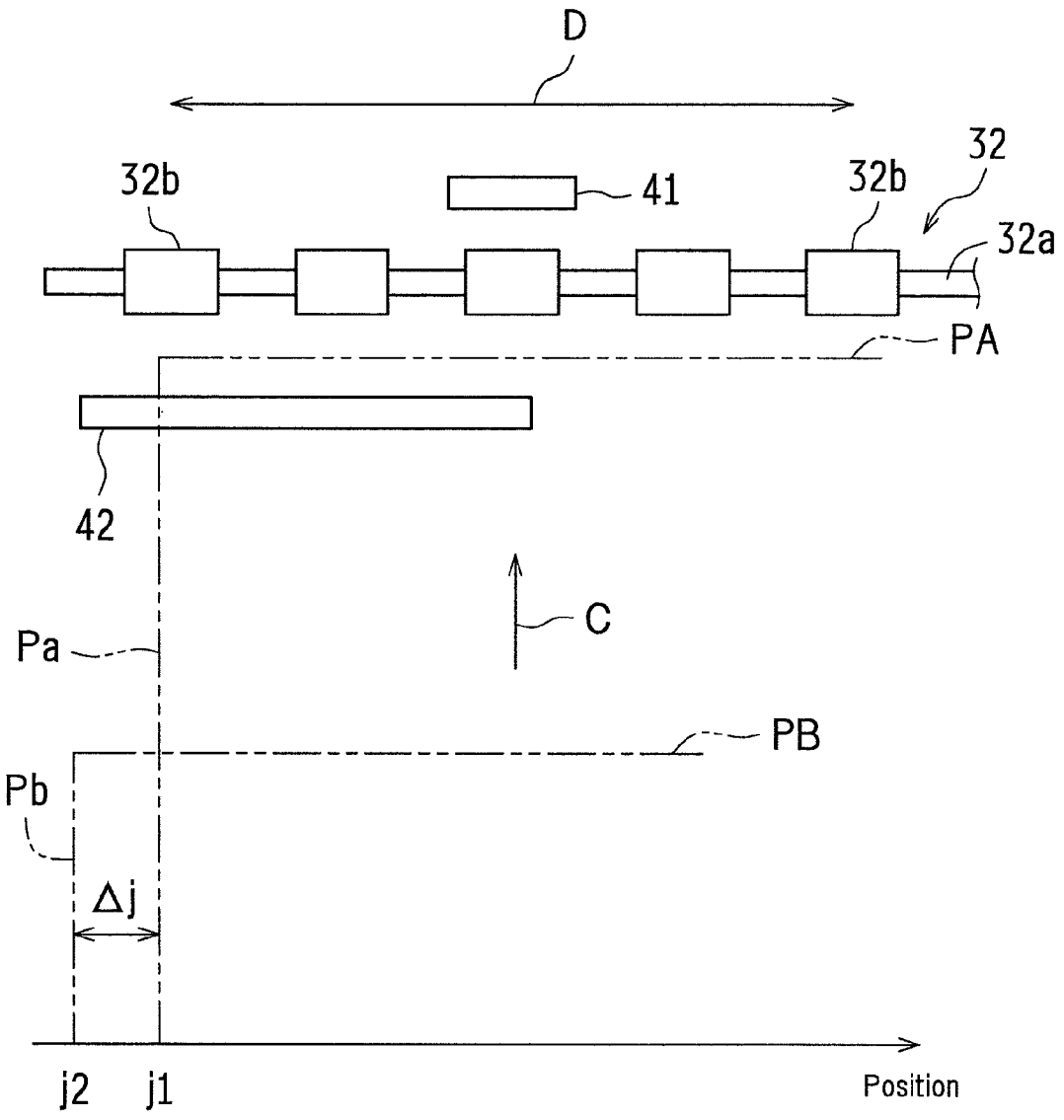
FIG. 7 is a plan view showing a state of detection of a side end of a recording paper by the line sensor in the image forming apparatus shown in FIG. 1.

Therefore, in this embodiment, the paper feed cassette 38A is preset to a reference paper feed cassette at the time of, for example, inspection of the image forming apparatus 1 before being shipped from the factory. The print position of a toner image in the main scanning direction D on a recording paper fed from this reference paper feed cassette 38A is adjusted as appropriate, and a reference image forming position ΔM corresponding to the writing start position on a main scanning line on the surface of the photosensitive drum 21 scanned by a laser beam of the laser exposure device 23 is obtained and set in advance. Further, as shown in FIG. 7, the side end pa of the recording paper P fed from the reference paper feed cassette 38A is detected by the line sensor 42, and the position of this side end pa of the recording paper P is set as the reference side end position j1. The reference image forming position ΔM and the reference side end position j1 obtained as above are stored in the memory unit.

Then when the image forming apparatus 1 is being used by a user, when a recording paper is fed from an arbitrary paper feed cassette among the paper feed cassettes 38A, 38B, and 38C, as shown in FIG. 7 the line sensor 42 detects the position of the side end pb in the main scanning direction D on the recording paper PB, obtains this side end position as a comparative side end position j2, and obtains the difference Δj between the reference side end position j1 and the comparative side end position j2 (see FIG. 7). After that, if the image print processing on recording papers fed from the same paper feed cassette is continued, the reference image forming position ΔM is corrected by the difference Δj, the adjusted image forming position ΔM1 (ΔM1=ΔM+Δj) is obtained, the writing start position on the main scanning line on the surface of the photosensitive drum 21 is adjusted in accordance with the obtained adjusted image forming position ΔM1, and writing of an electrostatic latent image with a laser beam on the surface of the photosensitive drum 21 is started.

Here, a light-receiving element is provided at a reference position on one end on the main scanning line scanned by a laser beam from the laser exposure device 23, and the writing start position on the main scanning line is changed by adjusting the time from the point when this light-receiving element detects the laser beam from the laser exposure device 23 to the point when writing on the main scanning line is started. When the writing start position is changed, the positions of the electrostatic latent image and the toner image in the main scanning direction D formed on the surface of the photosensitive drum 21 are changed, and the position of the toner image in the main scanning direction D transferred onto the recording paper in the nip area between the photosensitive drum 21 and the transfer roller 25 is changed.

Further, the difference Δj is the amount of shift in the main scanning direction D between the side end position of a recording paper fed from the reference paper feed cassette 38A and the side end position of a recording paper fed from the arbitrary paper feed cassette.

Therefore, the reference image forming position ΔM is corrected by the difference Δj in the main scanning direction D, the adjusted image forming position ΔM1 (ΔM1=ΔM+Δj) is obtained, the start position of writing with a laser beam on the main scanning line on the surface of the photosensitive drum 21 is changed in accordance with this adjusted image forming position ΔM1, and thus the positions of an electrostatic latent image and a toner image in the main scanning direction D on the surface of the photosensitive drum 21 are changed and the print position of the toner image on the recording paper fed from the arbitrary paper feed cassette is appropriately corrected.

Next, the specific process of correction on the print position of a toner image in the main scanning direction D on recording papers is described. When the image forming apparatus 1 is inspected before being shipped from the factory, as shown in FIG. 5, void adjustment for setting the widths sd and se of margin areas Bd and Be at both ends of the recording paper P is performed, and a toner image is transferred and printed inside the margin areas Bd and Be. Accordingly, the print position in the main scanning direction D can be adjusted by adjusting the widths sd and se in the margin areas Bd and Be, respectively.

The setting process of the print position of a toner image in the main scanning direction D on recording papers with this void adjustment is described with reference to the flowchart in FIG. 6.

First, a recording paper is fed from the reference paper feed cassette 38A to the nip area between the photosensitive drum 21 and the transfer roller 25. At this time, an electrostatic latent image of a test pattern is formed by the laser exposure device 23 on the surface of the photosensitive drum 21; the electrostatic latent image on the surface of the photosensitive drum 21 is developed by the developing device 24; a toner image of the test pattern is formed on the surface of the photosensitive drum 21; the recording paper is caused to be held at the nip area between the photosensitive drum 21 and the transfer roller 25; the toner image of the test pattern is transferred from the photosensitive drum 21 onto the recording paper, and the toner image of the test pattern on the recording paper is fixed by the fixing device 27 (step S101). In this process, the print control unit 59 adjusts and sets the start position of writing with a laser beam of the laser exposure device exposure device 23 in the main scanning direction D in accordance with the reference image forming position ΔM (initial value) stored in the memory unit 58, adjusts the positions of the electrostatic latent image and the toner image in the main scanning direction D formed on the surface of the photosensitive drum 21, and adjusts the position of the toner image in the main scanning direction D transferred onto the recording paper in the nip area between the photosensitive drum 21 and the transfer roller 25. Then, the print control unit 59 causes the line sensor 42 to detect the side end position in the main scanning direction of the recording paper, and temporarily sets this side end position as the reference side end position j1 and stores it in the memory unit 58 (step S102).

Then, an operator measures the widths sd and se of the margin areas Bd and Be on the recording paper P as shown in FIG. 5, and checks whether or not the difference between predetermined widths and the widths sd and se of the margin areas Bd and Be is an acceptable value or smaller.

If the difference between the predetermined width and the widths sd and se of the margin areas Bd and Be is not an acceptable value or smaller, the print position in the main scanning direction D is shifted. Accordingly, the print position is adjusted by changing the widths sd and se of the margin areas Bd and Be. The amount of the change in the widths sd and se of the margin areas Bd and Be may be instructed by operating the input operation unit 54 (step S103).

The arithmetic unit 57 in the main control unit 56 changes the reference image forming position ΔM (initial value) in accordance with the amount of the change in the widths sd and se of the margin areas Bd and Be instructed from the input operation unit 54, and temporarily sets this reference image forming position ΔM and stores it in the memory unit 58 (step S104). This reference image forming position ΔM is indicated by pixel numbers of pixels arranged on a predetermined pitch.

After that, the arithmetic unit 57 determines whether or not the amount of the change in the widths sd and se of the margin areas Bd and Be is a predetermined value or smaller (step S105), and if the amount of the change in the widths sd and se of the margin areas Bd and Be is not the predetermined value or smaller ("NO" at step S105), the processing returns to step S101.

In this case, the print control unit 59 adjusts and sets the start position of writing with a laser beam of the laser exposure device 23 in the main scanning direction D in accordance with the reference image forming position ΔM (the reference image forming position ΔM temporarily set at step S104 in the first session) stored in the memory unit 58, adjusts the positions of the electrostatic latent image and the toner image in the main scanning direction D formed on the surface of the photosensitive drum 21, and adjusts the position of the toner image in the main scanning direction D transferred onto the recording paper in the nip area between the photosensitive drum 21 and the transfer roller 25. Thus the widths sd and se of the margin areas Bd and Be are changed and the print position in the main scanning direction D is changed (step S101). Further, The side end position in the main scanning direction of the recording paper is detected by the line sensor 42, and this side end position is stored as the reference side end position j1 in the memory unit 58, thereby updating the temporarily set reference side end position j1 (step S102).

Then, an operator measures the widths sd and se of the margin areas Bd and Be on the recording paper P, and checks whether or not the difference between predetermined widths and the widths sd and se of the margin areas Bd and Be is an acceptable value or smaller.

If the difference between predetermined widths and the widths sd and se of the margin areas Bd and Be is not the acceptable value or smaller, the amount of further change in the widths sd and se of the margin areas Bd and Be is instructed by operating the input operation unit 54 (step S103), and the widths sd and se of the margin areas Bd and Be are changed again to re-adjust the print position.

The arithmetic unit 57 in the main control unit 56 updates, in accordance with the amount of the further change in the widths sd and se of the margin areas Bd and Be instructed from the input operation unit 54, the reference image forming position ΔM stored in the memory unit 58 (step S104).

After that, the arithmetic unit 57 determines whether or not the amount of the further change in the widths sd and se of the margin areas Bd and Be is a certain value or smaller (step S105). If the amount of change is not the certain amount or smaller ("No" at step S105), the processing returns again to step S101.

Meanwhile, if the amount of the change is the certain value or smaller ("Yes" at step S105), the reference side end position j1 and the reference image forming position ΔM stored in the memory unit 58 are determined and the processing of the flowchart in FIG. 6 ends. The determined reference side end position j1 and the reference image forming position ΔM are used in the print position adjustment in the main scanning direction to recording papers fed from any of the paper feed cassettes 38A, 38B, and 38C.

Steps S101 to 105 are repeated until the amount of the change in the widths sd and se of the margin areas Bd and Be becomes equal to or smaller than the certain amount for the purpose of checking the widths sd and se of the margin areas Bd and Be and improving the accuracy of the reference image forming position ΔM and the reference side end position j1.

Next, when the image forming apparatus 1 is used by a user, an arbitrary paper feed cassette among the paper feed cassettes 38A, 38B, and 38C is designated by operating the input operation unit 54, and the print control unit 59 in the main control unit 56 controls, via the motor control unit 53, the motor 52 for driving the pickup roller 39 and the like in the designated paper feed cassettes to feed a recording paper from that paper feed cassette. Then, the print control unit 59 controls the laser exposure device 23 via the laser control unit 55 to start writing of an electrostatic latent image with a laser beam on the surface of the photosensitive drum 21, and every time a laser beam scans in the main scanning direction, the start position of writing with the laser beam on the main scanning line is set in accordance with the reference image forming position ΔM stored in the memory unit 58. Further, regarding a recording paper fed from the arbitrary paper feed cassette, the arithmetic unit 57 obtains as a comparative side end position j2 the side end position in the main scanning direction detected by the line sensor 42, obtains a difference Δj between this comparative side end position j2 and the reference side end position j1 stored in the memory unit 58, adds this difference Δj to the reference image forming position ΔM stored in the memory unit 58, thus obtains an adjusted image forming position ΔM1, and stores this adjusted image forming position ΔM1 in the memory unit 58.

After that, if the print processing using the print unit 11 is continued by feeding a new recording paper from the paper feed cassette of which the adjusted image forming position ΔM1 stored in the memory unit 58, or performing the above-mentioned switch-back transport, the print control unit 59 controls the laser exposure device 23 via the laser control unit 55 to start writing the electrostatic latent image with a laser beam on the surface of the photosensitive drum 21, and sets the start position of writing with the laser beam on the main scanning line in accordance with the adjusted image forming position ΔM1 stored in the memory unit 58 every time the laser beam scans in the main scanning direction. Thus the print position of a toner image on the recording paper fed from the arbitrary paper feed cassette is changed by the difference Δj between the reference side end position j1 and the comparative side end position j2, and the toner image is printed at an appropriate print position on the recording paper.

However, regarding a recording paper fed from the arbitrary paper feed cassette, when the side end position in the main scanning direction of the recording paper is detected by the line sensor 42, writing of an electrostatic latent image with a laser beam on the surface of the photosensitive drum 21 has already started and the start position of writing with the laser beam on the main scanning line cannot be changed. Therefore, when a recording paper is fed from an arbitrary paper feed cassette, the start position of writing with the laser beam on the main scanning line is adjusted in accordance with the adjusted image forming position ΔM1 obtained for a recording paper fed previously from the same paper feed cassette (i.e., the adjusted image forming position ΔM1 determined based on the difference Δj and a reference image forming position ΔM obtained by the arithmetic unit 57 when a previous recording paper was fed from the arbitrary paper feed cassette before the current recording paper is fed from this paper feed cassette).

Here, as long as recording papers are fed from the same paper feed cassette, variation in the comparative side end position j2 detected by the line sensor is small even if a number of the recording papers are fed. Therefore, the print position of a toner image on a recording paper can be appropriately corrected also by obtaining the comparative side end position j2 and the adjusted image forming time ΔM1 with respect to a previous recording paper and changing the start position of writing with a laser beam on the main scanning line on the next sheet to the previous adjusted image forming position ΔM1.

The correction on the print position of a toner image in the main scanning direction D is performed on all paper feed cassettes 38A, 38B, and 38C, and it is therefore necessary to obtain the comparative side end position j2 and the adjusted image forming position ΔM1 with respect to each of the paper feed cassettes 38A, 38B, and 38C.

Meanwhile, an error occurs in the comparative side end position j2 even if variation in the comparative side end position j2 is small, and a similar error is also contained in the reference side end position j1. Accordingly, it cannot be determined whether or not the reference image forming position and the reference side end position are true positions, which do not contain any error.

Therefore, it is desirable to repeatedly obtain, every time a recording paper is fed from the same paper feed cassette, the comparative side end position j2 and the difference Δj between the reference side end position j1 and the comparative side end position j2, average the differences Δj, and obtain the adjusted image forming position ΔM1 by adding the average value of the differences to the reference image forming position ΔM.

Here, even if an error is contained in the reference side end position j1 and the comparative side end position j2, the difference Δj between the reference side end position j1 and the comparative side end position j2 is repeatedly obtained and the differences Δj are averaged, and then the average value of the differences converges into the difference between the reference side end position j1 and a true reference side end position that does not contain any error. Accordingly, the print position of a toner image on recording papers is corrected by adding the average value of the differences to the reference image forming position ΔM and obtaining the adjusted image forming position ΔM1, and thus the print position of the toner image on the recording papers converges into the most appropriate print position on the recording papers.

More specifically, every time a recording paper is fed from the same paper feed cassette, the comparative side end position j2 of the recording paper is measured by the line sensor 42, the difference Δj between the reference side end position j1 and the comparative side end position j2 is obtained, and the obtained difference Δj is temporarily stored in the memory unit 58 in association with the paper feed cassette from which the recording paper is fed. Then, the difference Δj is repeatedly obtained for the recording papers fed from the same paper feed cassette, all differences Δj associated with the paper feed cassette from which those recording papers are fed are read out from the memory unit 58, an average value of the differences Δj is obtained, the average difference Δj is added to the reference image forming position ΔM, the adjusted image forming position ΔM1 is thus obtained, and this adjusted image forming position ΔM1 is stored in the memory unit 58 in association with the paper feed cassette from which the recording papers are fed.

Meanwhile, every time a laser beam scans in the main scanning direction, the print control unit 59 sets the start position of writing with the laser beam on the main scanning line in accordance with the adjusted image forming position ΔM1 stored in the memory unit 58 corresponding to the paper feed cassette from which the recording paper is fed, changes the positions of the electrostatic latent image and the toner image in the main scanning direction D formed on the surface of the photosensitive drum 21, and changes the position of the toner image in the main scanning direction D transferred onto the recording paper in the nip area between the photosensitive drum 21 and the transfer roller 25. Thus the print position of the toner image on the recording paper is made closer to the most appropriate print position. In other words, the print control unit 59 sets, when a recording paper is fed from an arbitrary paper feed cassette among the paper feed cassettes 38A, 38B, and 38C, the start position of writing with a laser beam on the main scanning line in accordance with the adjusted image forming position ΔM1 determined based on the reference image forming position ΔM and the average difference Δj obtained by the arithmetic unit 57 every time a recording paper was fed from the arbitrary paper feed cassette before the current recording paper is fed, adjusts the positions of the electrostatic latent image and the toner image in the main scanning direction D formed on the surface of the photosensitive drum 21, adjusts the position of the toner image in the main scanning direction D transferred onto the recording paper in the nip area between the photosensitive drum 21 and the transfer roller 25, and the print position of the toner image on the recording paper is thereby made closer to the most appropriate print position.

Next, an example of the specific process for obtaining the reference image forming position ΔM and the adjusted image forming position ΔM1 is described with reference to the transition diagrams shown in FIGS. 8A and 8B.

Here, the reference paper feed cassette 38A and another paper feed cassette 38B are focused. The difference Δj, the reference image forming position ΔM, and the adjusted image forming position ΔM1 are indicated by pixel numbers of pixels arranged on a predetermined pitch. Further, the reference side end position j1 is the distance from a predetermined position in the design of the image forming apparatus 1 to the reference side end position j1 separate in the main scanning direction, and is indicated by a pixel number. The adjusted image forming position ΔM1 is a value obtained by adding the difference Δj to the reference image forming position ΔM.

Figure 8A:
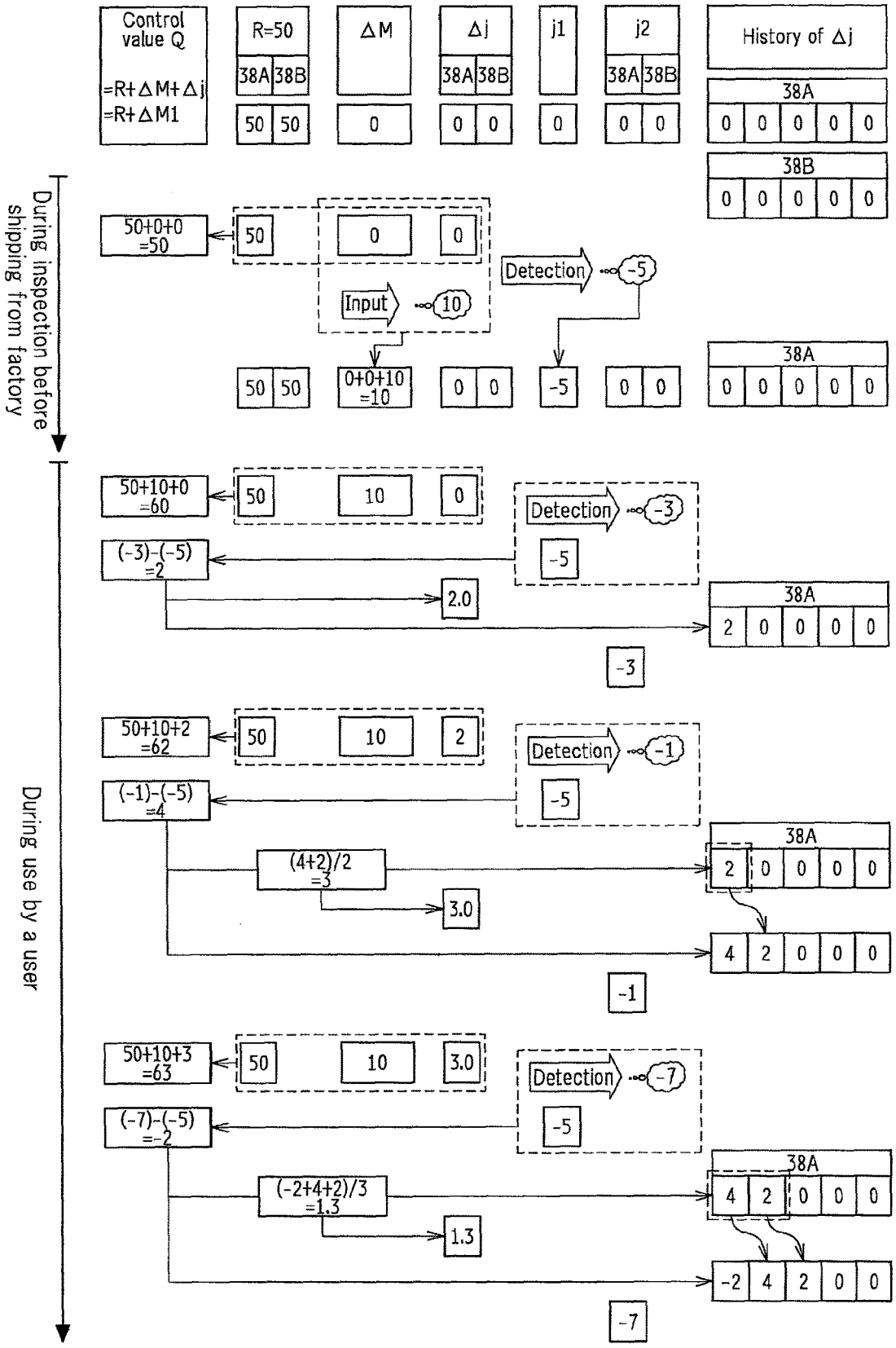
FIG. 8A is a transition diagram showing a process of correcting shifted print of a toner image on a recording paper in a main scanning direction according to an embodiment of the present invention.

As shown in FIG. 8A, before the image forming apparatus 1 is inspected before being shipped from the factory, the image forming position is set in advance to an initial value R (=50) with respect to recording papers fed from each of the paper feed cassettes 38A and 38B. This initial value R is a design value for the image forming apparatus 1 and indicates the time (pixel number) from the point when the light-receiving element provided at a reference position in one end on the main scanning line detects a laser beam of the laser exposure device 23 to the point when writing with the laser beam on the main scanning line is started. Further, the reference image forming position ΔM and the difference Δj are initially set to "0."

In this state, in accordance with the flowchart in FIG. 6, a toner image of a test pattern is printed on a recording paper, the reference side end position j1 in the main scanning direction of the recording paper is detected by the line sensor 42, the widths sd and se of the margin areas Bd and Be on the recording paper P are measured, the amount of change in the widths sd and se of the margin area Bd and Be is instructed by operating the input operation unit 54, and the reference image forming position ΔM is adjusted to adjusts the print position in the main scanning direction D. This process is repeatedly performed. Then, the reference image forming position ΔM (=10) and the reference side end position j1 (=−5) are stored in the memory unit 58 and determined, and the sum of the initial value R, the reference image forming position ΔM, and an initial value of the difference Δj (i.e., "0") is stored as a control value Q (=60) in the memory unit 58.

Next, when the image forming apparatus 1 is used by a user, for example when a first recording paper is fed from the paper feed cassette 38A, the start position of writing with a laser beam on the main scanning line is set to the control value Q (the sum of the initial value R and the reference image forming position ΔM) corresponding to the reference image forming position ΔM stored in the memory unit 58, and writing of an electrostatic latent image on the surface of the photosensitive drum 21 is started. Then, the electrostatic latent image on the surface of the photosensitive drum 21 is developed by the developing device 24, a toner image is formed on the surface of the photosensitive drum 21, and the toner image is transferred from the photosensitive drum 21 onto the recording paper in the nip area between the photosensitive drum 21 and the transfer roller 25.

Further, the comparative side end position j2 (=−3) in the main scanning direction on the recording paper is detected by the line sensor 42, the difference Δj (=2) between the reference side end position j1 and the comparative side end position j2 is obtained and stored in the memory unit 58.

Accordingly, regarding the first recording paper, the toner image is printed at the print position in the main scanning direction D corresponding to the reference image forming position ΔM set at the factory, and the comparative side end position j2 and the difference Δj are obtained for the first time.

Subsequently, when the second recording paper is fed from the paper feed cassette 38A, the difference Δj (=2) is added to the control value Q (initial value R+reference image forming position ΔM=60) corresponding to the reference image forming position ΔM (=10) stored in the memory unit 58, the control value Q "62" corresponding to the adjusted image forming position ΔM1 (the sum of the initial value R and the adjusted image forming position ΔM1 (reference image forming position ΔM+difference Δj)) is obtained, the start position of writing with a laser beam on the main scanning line is set to the control value Q corresponding to the adjusted image forming position ΔM1, writing of the electrostatic latent image on the surface of the photosensitive drum 21 is started, the electrostatic latent image is developed, and a toner image is transferred onto the recording paper in the nip area.

Further, the comparative side end position j2 (=−1) in the main scanning direction of the recording paper is detected by the line sensor 42, the difference Δj (=4) between the reference side end position j1 and the comparative side end position j2 is obtained and stored in the memory unit 58, the previous difference Δj (=2) and the current difference Δj (=4) are averaged, and the average value /Δj (=3) of those differences is obtained and stored in the memory unit 58. As shown in FIGS. 8A and 8B, the memory unit 58 is provided with a storage area for storing the history of the average difference /Δj, the comparative side end position j2, and the difference Δj with respect to each of the paper feed cassettes 38A and 38B, and the difference Δj obtained when a recording paper is fed from the paper feed cassette 38A and the average difference /Δj are stored in the storage area for the paper feed cassette 38A.

Accordingly, regarding the second recording paper, the difference Δj obtained regarding the first recording paper is added to the reference image forming position ΔM, the adjusted image forming position ΔM1 is obtained, a toner image is printed at the print position in the main scanning direction D corresponding to the adjusted image forming position ΔM1, and the average difference /Δj of the differences Δj is obtained for the first time.

Subsequently, when the third recording paper is fed from the paper feed cassette 38A, the average difference /Δj (=3) is added to the control value Q (initial value R+reference image forming position ΔM=60) corresponding to the reference image forming position ΔM (=10) stored in the memory unit 58, the control value Q "63" corresponding to the adjusted image forming position ΔM1 (the sum of the initial value R and the adjusted image forming position ΔM1 (reference image forming position ΔM+difference Δj)) is obtained, the start position of writing with a laser beam on the main scanning line is set to the control value Q corresponding to the adjusted image forming position ΔM1, writing of the electrostatic latent image on the surface of the photosensitive drum 21 is started, the electrostatic latent image is developed, and a toner image is transferred onto the recording paper in the nip area.

Further, the comparative side end position j2 (=−7) in the main scanning direction of the recording paper is detected by the line sensor 42, the difference Δj (=−2) between the reference side end position j1 and the comparative side end position j2 is obtained and stored in the memory unit 58, the differences Δj (=2, 4, −2) obtained so far are averaged, and this average difference /Δj (=1.3) is obtained and stored in the memory unit 58.

Accordingly, regarding the third recording paper, the average difference /Δj of the differences Δj obtained regarding the first and second recording papers is added to the reference image forming position ΔM, the adjusted image forming position ΔM1 is obtained, a toner image is printed at the print position in the main scanning direction D corresponding to the adjusted image forming position ΔM1, and the average difference /Δj of the differences Δj is updated.

Similarly, when an nth recording paper is fed from the paper feed cassette 38A, the average value/Δj of the differences Δj obtained with respect to the first to (n−1)th recording papers is added to the control value Q (=60) corresponding to reference image forming position ΔM stored in the memory unit 58, the control value Q corresponding to the adjusted image forming position ΔM1 is thus obtained, the start position of writing with a laser beam in the main scanning line is set to the control value Q corresponding to the adjusted image forming position ΔM1, writing of an electrostatic latent image on the surface of the photosensitive drum 21 is started, the electrostatic latent image is developed, and a toner image is transferred onto the recording paper in the nip area. Then, the comparative side end position j2 in the main scanning direction of the recording paper is detected by the line sensor 42, the difference Δj between the reference side end position j1 and the comparative side end position j2 is obtained and stored in the memory unit 58, the differences Δj obtained so far are averaged, and the average difference /Δj is obtained and stored in the memory unit 58.

The average value /Δj may also be updated only when the difference Δj between the reference side end position 31 and the comparative side end position j2 is a certain value or smaller. Thus the influence from irregular comparative side end position j2 caused by erroneous detection by the line sensor 42 can be eliminated. Further, to save the capacity of the memory unit 58, the number of stored differences Δj may be limited and oldest differences Δj may be sequentially deleted. Further, the average value /Δj and the number k of differences Δj used to obtain the average value /Δj may be stored, and the average value /Δj may be updated based on the newly obtained difference Δj, the average value /Δj, and the number k.

Figure 8B:
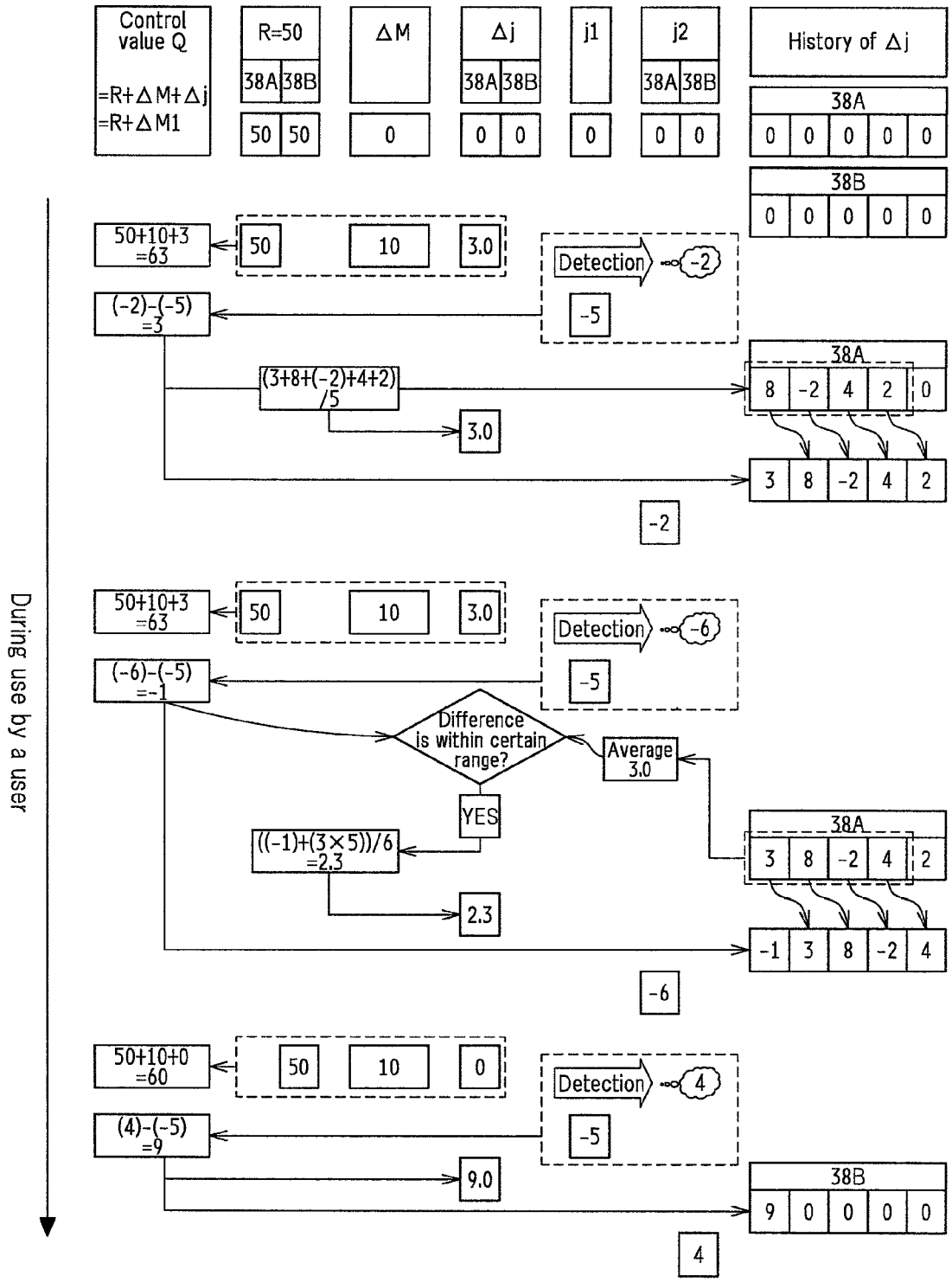
FIG. 8B is a transition diagram showing a process subsequent to the process shown in the transition diagram of FIG. 8A.

For example, in the example shown in FIG. 8B, the number of the differences Δj stored is limited to "5," and the average value /Δj is updated only when the difference Δj is in the range from −5 to +5. Further, every time the average value /Δj is updated, the number k of the differences Δj used to obtain the average value /Δj is stored.

In the example shown in FIG. 8B, when the fifth recording paper is fed from the paper feed cassette 38A, as in the above-described process performed for the first to third sheets, the average value /Δj (=3) is added to the control value Q (initial value R+reference image forming position ΔM=60) corresponding to the reference image forming position ΔM (=10) stored in the memory unit 58, the control value Q "63" (the sum of the initial value R and the adjusted image forming position ΔM1 (reference image forming position ΔM+difference Δj)) corresponding to the adjusted image forming position ΔM1 is obtained, the start position of writing with a laser beam on the main scanning line is set to the control value Q corresponding to the adjusted image forming position ΔM1, writing of an electrostatic latent image on the surface of the photosensitive drum 21 is started, the electrostatic latent image is developed, and a toner image is transferred onto the recording paper in the nip area. Further, the comparative side end position j2 (=−2) in the main scanning direction of the recording paper is detected by the line sensor 42, the difference Δj (=3) between the reference side end position j1 and the comparative side end position j2 is obtained and stored in the memory unit 58, the differences Δj (=2, 4, −2, 8, 3) obtained so far are averaged, and this average difference /Δj (=3.0) is obtained and stored in the memory unit 58. Further, the number k (=5) of the differences Δj used to obtain the average value /Δj is stored. Accordingly, regarding the fifth recording paper, the average value /Δj of the differences Δj obtained with respect to the first to fourth recording papers is added to the reference image forming position ΔM, the adjusted image forming position ΔM1 is obtained, a toner image is printed at the print position in the main scanning direction D corresponding to the adjusted image forming position ΔM1, and the average difference /Δj of the differences Δj and the number k of the differences Δj used to obtain the average difference /Δj are updated.

Then, in the example shown in FIG. 8B, when the sixth recording paper is fed from the paper feed cassette 38A, the average difference /Δj (=3) is added to the control value Q (initial value R+reference image forming position ΔM=60) corresponding to the reference image forming position ΔM (=10) stored in the memory unit 58, the control value Q "63" corresponding to the adjusted image forming position ΔM1 (the sum of the initial value R and the adjusted image forming position ΔM1 (reference image forming position ΔM+difference Δj)) is obtained, the start position of writing with a laser beam on the main scanning line is set to the control value Q corresponding to the adjusted image forming position ΔM1, writing of the electrostatic latent image on the surface of the photosensitive drum 21 is started, the electrostatic latent image is developed, and a toner image is transferred onto the recording paper in the nip area. Further, the comparative side end position j2 (=−6) in the main scanning direction on the recording paper is detected by the line sensor 42, the difference Δj (=−1) between the reference side end position j1 and the comparative side end position j2 is obtained. If the obtained difference Δj (=−1) is within a certain range (in the range from −5 to +5 in this example), the obtained difference Δj (=−1) is stored in the memory unit 58 (at this time, among the differences Δj stored in the memory unit 58 the difference Δj (=2) of the oldest stored date is deleted from the memory unit 58), the average value (=(−1+3×5)/6) of the differences is obtained based on the stored difference Δj, the average value (=3.0) of the differences Δj obtained so far, and the number k (=5) of the differences Δj used to obtain the average value /Δj, and the obtained average value /Δj (=3.0) of the differences and the number k(=6) of the differences Δj used to obtain the average value /Δj (=3.0) are stored in the memory unit 58. Meanwhile, if the obtained difference Δj is out of a certain range (out of the range from −5 to +5 this example), the obtained difference Δj is not stored in the memory unit 58, and the average value of the differences Δj is not obtained either (i.e., the average value of the differences Δj stored in the memory unit 58 is not updated).

Further, when the first recording paper is fed from the other paper feed cassette 38B, as shown in FIG. 8B, the start position of writing with a laser beam on the main scanning line is set in accordance with the control value Q (=60) corresponding to the reference image forming position ΔM stored in the memory unit 58, writing of an electrostatic latent image on the surface of the photosensitive drum 21 is started, the electrostatic latent image is developed, and a toner image is transferred onto the recording paper in the nip area.

Further, the comparative side end position j2 (=4) in the main scanning direction of the recording paper is detected by the line sensor 42, the difference Δj (=9) between the reference side end position j1 and the comparative side end position j2 is obtained and stored in the memory unit 58.

Accordingly, regarding the first recording paper fed from the paper feed cassette 38B, the toner image is printed at the print position in the main scanning direction D corresponding to the reference image forming position ΔM set at the factory, and the comparative side end position j2 and the difference Δj are obtained for the first time.

Subsequently, when the second recording paper is fed from the other paper feed cassette 38B, the difference Δj (=9) is added to the control value Q (=60) stored in the memory unit 58, the control value Q "69" corresponding to the adjusted image forming position ΔM1 is obtained, the start position of writing with a laser beam on the main scanning line is set to the control value Q corresponding to the adjusted image forming position ΔM1, writing of the electrostatic latent image on the surface of the photosensitive drum 21 is started, the electrostatic latent image is developed, and a toner image is transferred onto the recording paper in the nip area.

Further, the comparative side end position j2 in the main scanning direction on the recording paper is detected by the line sensor 42, the difference N between the reference side end position j1 and the comparative side end position j2 is obtained and stored in the memory unit 58, the previous difference Δj (=9) and the current difference Δj are averaged, and the average value /Δj of those differences is obtained and stored in the memory unit 58. As shown in FIGS. 8A and 8B, the memory unit 58 is provided with a storage area for storing the history of the average difference /Δj, the comparative side end position j2, and the difference Δj with respect to each of the paper feed cassettes 38A and 38B, and the difference Δj obtained when a recording paper is fed from the paper feed cassette 38B and the average difference /Δj are stored in the storage area for the paper feed cassette 38B.

Accordingly, regarding the second recording paper fed from the paper feed cassette 38B, the difference Δj obtained regarding the first recording paper is added to the reference image forming position ΔM, the adjusted image forming position ΔM1 is obtained, a toner image is printed at the print position in the main scanning direction D corresponding to the adjusted image forming position ΔM1, and the average difference /Δj of the differences Δj is obtained for the first time.

Subsequently, when third and subsequent recording papers are fed from the paper feed cassette 38B, as in the above-described process for the reference paper feed cassette 38A, the control value Q corresponding to the adjusted image forming position ΔM1 is set again, the difference Δj is obtained, and the average value /Δj of the differences is obtained.

As described above, in the correction on the print position of a toner image in the main scanning direction D on a recording paper, when the image forming apparatus 1 is inspected before being shipped from the factory, the print position of the toner image in the main scanning direction D on a recording paper fed from the reference paper feed cassette 38A is adjusted, the reference image forming position ΔM is set, the side end position of the recording paper in the main scanning direction is detected by the line sensor 42, and this side end position is obtained as the reference side end position j1. Then, when the image forming apparatus 1 is used by a user, regarding a recording paper fed from an arbitrary paper feed cassette among the paper feed cassettes 38A, 38B, and 38C, the comparative side end position j2 in the main scanning direction of the recording paper is detected by the line sensor 42, the difference Δj between the reference side end position j1 and the comparative side end position j2 is obtained, the reference image forming position ΔM is corrected in accordance with the difference Δj, and thus the adjusted image forming position ΔM1 for setting the appropriate print position of the toner image on the recording paper fed from the arbitrary paper feed cassette is obtained.

Therefore, when the image forming apparatus 1 is inspected before being shipped from the factory, the reference image forming position ΔM and the reference side end position j1 only with respect to the reference paper feed cassette 38A have to be set, and so the adjustment and settings are simple.

Further, every time a recording paper is fed from the same paper feed cassette, the difference Δj between the reference side end position j1 and the comparative side end position j2 is repeatedly obtained, those differences Δj are averaged, this average value /Δj of the differences is added to the reference image forming position ΔM, and the adjusted image forming position ΔM1 is obtained. Accordingly, the print position of a toner image on the recording paper converges into the most appropriate print position on the recording paper.

Incidentally, although in the above-described embodiment the print position of a toner image on a recording paper is adjusted and corrected in the sub-scanning direction and the main scanning direction with respect to each paper feed cassette, the print position of a toner image on a recording paper may alternatively be adjusted and corrected in the sub-scanning direction and the main scanning direction with respect to each type of the recording papers.

In this case, the recording papers are classified by sizes or basis weights (or thicknesses). This is because if the size or basis weight (or thickness) of the recording papers varies, the print position of a toner image on the recording papers shifts. For example, the position of the leading end of the recording papers, when the recording papers is caused to abut against the registration roller pair 32, varies depending on the size or basis weight of the recording papers, which causes shifts of the print position of a toner image on the recording papers.

For example, assuming that the recording papers of the normal size and normal basis weight (or normal thickness) are contained in the paper feed cassette 38A and the recording papers of different types are contained in the paper feed cassette 38B and 38C, the print position of a toner image on the recording papers can be corrected in almost the same manner as in the above-described embodiment.

In other words, in the correction on the print position of a toner image in the sheet transport direction C on a recording paper, when the image forming apparatus 1 is inspected before being shipped from the factory, a recording paper of the normal size and normal basis weight (or normal thickness) is fed from the reference paper feed cassette 38A, the print position of the toner image in the sheet transport direction C on this recording paper is adjusted, the reference image forming time ΔT is set, and the reference time Δt11 from point t2 when the registration roller pair 32 starts transporting to point t3 when the sheet leading end sensor 41 detects the leading end of the recording paper is obtained. The reference image forming time ΔT and the reference time Δt11 are stored in the memory unit 58. Then, when the image forming apparatus 1 is used by a user, the arithmetic unit 57, regarding a recording paper of an arbitrary type fed from one of the paper feed cassettes 38A, 38B, and 38C, obtains, as a comparative time, a time Δt12 from point t2 when the registration roller pair 32 starts transporting to point t3 when the sheet leading end sensor 41 detects the leading end of the recording paper (i.e., a time detected by the time measuring unit 571), corrects the reference image forming time ΔT based on the difference dt between the reference time Δt11 and the comparative time Δt12, and thus obtains an adjusted image forming time ΔT1 for setting an appropriate print position of the toner image on the recording paper of the arbitrary type.

Further, every time a recording paper of the same type is fed, the difference dt is repeatedly obtained, those differences dt are averaged, the average difference /dt is subtracted from the reference image forming time ΔT, the adjusted image forming time ΔT1 is thus obtained, and the print position of the toner image on the recording paper is caused to converge into the most appropriate print position on the recording paper.

Similarly, in the correction on the print position of a toner image in the main scanning direction D on the recording papers, when the image forming apparatus 1 is inspected before being shipped from the factory, a recording paper of the normal size and normal basis weight (or normal thickness) is fed from the reference paper feed cassette 38A, the print position of the toner image in the main scanning direction D on the fed recording paper is adjusted, the reference image forming position ΔM is set, and the reference side end position j1 in the main scanning direction on the recording paper is detected by the line sensor 42. The reference image forming position ΔM and the reference side end position j1 are stored in memory unit 58. Then, when the image forming apparatus 1 is used by a user, regarding a recording paper of an arbitrary type fed from one of the paper feed cassettes 38A, 38B, and 38C, the arithmetic unit 57 obtains, as a comparative side end position j2, the side end position in the main scanning direction of the recording paper detected by the line sensor 42, obtains a difference Δj between the reference side end position j1 and the comparative side end position j2, corrects the reference image forming position ΔM in accordance with the difference Δj, and thus obtains an adjusted image forming position ΔM1 for setting the appropriate print position of the toner image on the recording paper of the arbitrary type fed from the paper feed cassette.

Further, the difference Δj is repeatedly obtained every time a recording paper of the same type is fed from the paper feed cassette, those differences Δj are averaged, the reference image forming position ΔM is corrected based on this average difference /Δj, the adjusted image forming position ΔM1 is thus obtained, and the print position of the toner image on the recording paper converges into the most appropriate print position on the recording paper.

However, if the type of the recording papers contained in a paper feed cassette is changed, the average value /dt obtained by averaging the differences dt and the average value /Δj obtained by averaging the differences Δj need to be initialized. Alternatively, the average value /dt, the average value /Δj, and the number k of the differences used to obtain these average values may be stored and left in the memory unit 58 in association with each type of the recording papers, and when recording papers of the same type are put in the paper feed cassette again and that type is designated from the input operation unit 54, the stored average value /dt, average value /Δj and the number k corresponding to the type may be read out from the memory unit 58 and used again.

Further, regarding multiple types of recording papers replaced in a single paper feed cassette as well, the print position on a toner image on the recording papers can be corrected as in the above-described embodiment.

In this case, in the correction on the print position of a toner image in the sheet transport direction C on a recording paper, when the image forming apparatus 1 is inspected before being shipped from the factory, a recording paper of the normal size and normal basis weight (or normal thickness) is fed from the paper feed cassette, the print position of the toner image in the sheet transport direction C on this recording paper is adjusted, the reference image forming time ΔT is set, and the reference time Δt11 is obtained. The reference image forming time ΔT and the reference time Δt11 are stored in the memory unit 58. Then, when the image forming apparatus 1 is used by a user, the arithmetic unit 57, regarding a recording paper of an arbitrary type fed from the paper feed cassette, obtains, as a comparative time, a time Δt12 from point t2 when the registration roller pair 32 starts transporting to point t3 when the sheet leading end sensor 41 detects the leading end of the recording paper (i.e., a time detected by the time measuring unit 571), corrects the reference image forming time ΔT based on the difference dt between the reference time Δt11 and the comparative time Δt12, and thus obtains an adjusted image forming time ΔT1 for setting the appropriate print position of the toner image on the recording papers of this type. After that, when the recording paper of the arbitrary type is fed from the paper feed cassette, the length of the image forming period (more specifically, the period from point t1 when writing of an electrostatic latent image on the surface of the photosensitive drum 21 in the sub-scanning direction is started to point t2 when the registration roller pair 32 starts transporting) is adjusted in accordance with the adjusted image forming time ΔT1 obtained as above, and thus the print position of the toner image on the recording paper of this type is adjusted. In other words, when a recording paper of an arbitrary type is fed from the paper feed cassette, the print control unit 59 adjusts the length of the image forming period in accordance with the adjusted image forming time ΔT1 determined based on the reference image forming time ΔT and the difference dt obtained by the arithmetic unit 57 when a recording paper of the arbitrary type was fed previously from the paper feed cassette before the current recording paper is fed.

Further, every time a recording paper of the same type is fed, the differences dt are averaged, the average value /dt of the differences is subtracted from the reference image forming time ΔT, thereby obtaining the adjusted image forming time ΔT1, and the print position of the toner image on the recording paper converges into the most appropriate print position on the recording paper. More specifically, when a recording paper of an arbitrary type is fed from the paper feed cassette, the print control unit 59 adjusts the length of the image forming period in accordance with the adjusted image forming time ΔT1 determined based on the average value /dt of the differences dt and the reference image forming time ΔT obtained by the arithmetic unit 57 before this recording paper is fed and every time a recording paper of the arbitrary type was fed from the paper feed cassette.

Similarly, in the correction of the print position of a toner image in the main scanning direction D on a recording paper, when the image forming apparatus 1 is inspected before being shipped from the factory, a recording paper of the normal size and normal basis weight (or normal thickness) is fed from the paper feed cassette, the print position of the toner image in the main scanning direction D on the recording paper is adjusted, the reference image forming position ΔM is set, and the reference side end position j1 in the main scanning direction on the recording paper is detected. The reference image forming position ΔM and the reference side end position j1 are in the memory unit 58. Then when the image forming apparatus 1 is used by a user, the arithmetic unit 57, regarding a recording paper of an arbitrary type fed from the paper feed cassette, obtains, as a comparative side end position j2, the side end position in the main scanning direction of the recording paper detected by the line sensor 42, obtains a difference Δj between the reference side end position j1 and the comparative side end position j2, corrects the reference image forming position ΔM based on this difference Δj, and thus obtains an adjusted image forming position ΔM1 for setting the appropriate print position of the toner image on the recording paper of the same type as the current recording paper. After that, when a recording paper of the same type is fed from the paper feed cassette, the start position of writing with the laser beam on the main scanning line is adjusted in accordance with the above-obtained adjusted image forming position ΔM1, the positions of the electrostatic latent image and the toner image in the main scanning direction D formed on the surface of the photosensitive drum 21 are adjusted, and the position of the toner image in the main scanning direction D transferred onto the recording paper in the nip area between the photosensitive drum 21 and the transfer roller 25 is thus adjusted. In other words, when a recording paper of an arbitrary type is fed from the paper feed cassette, the print control unit 59 adjusts the start position of writing with a laser beam on the main scanning line in accordance with the adjusted image forming position ΔM1 determined based on the difference and the reference image forming position ΔM obtained by the arithmetic unit 57 before this recording paper is fed and when a recording paper of the arbitrary type was fed from the paper feed cassette.

Further, every time a recording paper of the same type is fed, the differences Δj are averaged, the average value /Δj of the differences is added to the reference image forming position ΔM, the adjusted image forming position ΔM1 is thus obtained, and the print position of the toner image on the recording paper is caused to converge into the most appropriate print position on the recording paper. More specifically, when a recording paper of an arbitrary type is fed from the paper feed cassette, the print control unit 59 adjusts the start position of writing with a laser beam on the main scanning line in accordance with the adjusted image forming position ΔM1 determined based on the reference image forming position ΔM and the average value /Δj of the differences obtained by the arithmetic unit 57 every time a recording paper of the same type was fed previously from the paper feed cassette before the current recording paper is fed.

Further, if the type of the recording papers contained in a paper feed cassette is changed, the average value /dt obtained by averaging the differences dt and the average value /Δj obtained by averaging the differences Δj are initialized. Alternatively, the average value /dt, the average value /Δj, and the number k of the differences used to obtain these average values may be stored and left in the memory unit 58 in association with each type of the recording papers, and when recording papers of the same type are put in the paper feed cassette again and that type is designated from the input operation unit 54, the stored average value /dt, average value /Δj and the number k corresponding to the type may be read out from the memory unit 58 and used again.

Further, the present invention is also applicable to the manual feed trays (paper feed unit) for containing and feeding recording papers of any size, as well as to the paper feed cassettes. For example, the comparative time is obtained when a recording paper is fed from the manual feed tray, the difference between the reference time and the comparative time is obtained, the image forming timing set in advance with respect to the recording papers fed from the reference paper feed cassette is corrected based on the difference, and thus the print position of an image on the recording paper fed from the manual feed tray is corrected. Alternatively, the comparative side end position is obtained when a recording paper is fed from the manual feed tray, the difference between the reference side end position and the comparative side end position is obtained, the image forming position set in advance with respect to the recording papers fed from the reference paper feed cassette is corrected based on the difference, and thus the print position of an image on the recording paper fed from the manual feed tray is corrected.

The preferable embodiment of the present invention has been described with reference to the accompanying drawings, but needless to say the present invention is not limited the above-described examples. It is obvious that a person skilled in the art would arrive at various modified or revised examples within the scope stated in the claims, and it is understood that those modified or revised examples also naturally belong to the technical scope of the present invention.

The present invention may be implemented in various other ways without departing from the spirit or essential characteristics thereof. Therefore, the above-described embodiment is only an example and should not be interpreted as being limiting. The scope of the present invention is indicated in the claims and not at all restricted by the specification itself. Furthermore, all variations or modifications that come within the meaning and range of equivalency of the claims are intended to be embraced therein.

DESCRIPTION OF REFERENCE NUMERALS

1 Image Forming Apparatus
11 Print Unit
12 Sheet Transport Unit
13 Paper Supply Unit
21 Photosensitive Drum
22 Charging Device
23 Laser Exposure Device
24 Developing Device
25 Transfer Roller
26 Cleaning Device
32 Registration Roller Pair
38A, 38B, 38C Paper Feed Cassette (paper feed unit)
41 Sheet Leading End Sensor
42 Line Sensor (Side end sensor)
51 Driving Unit
52 Motor
53 Motor Control Unit
54 Input Operation Unit
55 Laser Control Unit
56 Main Control Unit
57 Arithmetic Unit
571 Time measuring Unit
58 Memory Unit
59 Print control Unit

What is claimed is:

1. An image forming apparatus, comprising:

a plurality of paper feed units;

a print unit for forming an image and printing the formed image on a recording paper;

a registration roller, arranged between the paper feed units and the print unit, for receiving a recording paper transported from one of the paper feed units and transporting the recording paper to the print unit;

a sheet leading end sensor provided downstream, in a transport direction of the recording paper, of the registration roller, for detecting a leading end of the recording paper;

a time measuring unit for measuring a time from a start point of transportation of the recording paper by the registration roller to a point of detection of the leading end of the recording paper by the sheet leading end sensor;

a memory unit for storing a reference image forming time, which is a reference value of a length of an image forming period from an image formation start point in the print unit to the start point of transportation of the recording paper by the registration roller and a reference time, which is a reference value of a time from the start point of transportation to the point of detection of the leading end of the recording paper by the sheet leading end sensor;

a print control unit for adjusting, when a recording paper is fed from an arbitrary paper feed unit among the paper feed units, a print position of an image on the recording paper by controlling the print unit and the registration roller to adjust the length of the image forming period; and an arithmetic unit for obtaining, as a comparative time, a time detected by the time measuring unit when the leading end of the recording paper is detected by the sheet leading end sensor, obtaining a time difference between the obtained comparative time and the reference time stored in the memory unit every time a recording paper is fed from the paper feed unit, and storing the time difference in the memory unit in association with the paper feed unit from which the recording paper is fed, wherein the print control unit adjusts, when the recording paper is fed from a specific paper feed unit among the paper feed units, the length of the image forming period in accordance with an adjusted image forming time obtained by subtracting the time difference, previously obtained by the arithmetic unit and stored in the memory unit in association with the specific paper feed unit from which the recording paper is fed before the recording paper is fed, from the reference image forming time stored in the memory unit.

2. The image forming apparatus according to claim 1, wherein the print unit includes: an image carrier; a writing unit for writing an electrostatic latent image on the image carrier; a developing unit for developing the electrostatic latent image on the image carrier into a toner image; and a transfer unit for transferring the toner image on the image carrier onto the recording paper, and the print control unit adjusts the length of the image forming period, which is a period from a start point of writing of the electrostatic latent image in a sub-scanning direction by the writing unit to the start point of transportation by the registration roller.

3. The image forming apparatus according to claim 1, further comprising an input operation unit operated to adjust and set the reference image forming time.

4. The image forming apparatus according to claim 1, wherein the print control unit adjusts, when a recording paper is fed from an arbitrary paper feed unit among the paper feed units, the length of the image forming period in accordance with an adjusted image forming time determined based on the reference image forming time stored in the memory unit and an average value of the differences obtained by the arithmetic unit and stored in the memory unit before the recording paper is fed and every time another recording paper was fed from the arbitrary paper feed unit.

5. An image forming apparatus, comprising:

a paper feed unit;

a print unit for forming an image and printing the formed image on a recording paper;

a registration roller, arranged between the paper feed unit and the print unit, for receiving a recording paper transported from the paper feed unit and transporting the recording paper to the print unit;

a sheet leading end sensor provided downstream, in a transport direction of the recording paper, of the registration roller, for detecting a leading end of the recording paper;

a time measuring unit for measuring a time from a start point of transportation of the recording paper by the registration roller to a point of detection of the leading end of the recording paper by the sheet leading end sensor;

a memory unit for storing a reference image forming time, which is a reference value of a length of an image forming period from an image formation start point in the print unit to the start point of transportation of the recording paper by the registration roller, and a reference time, which is a reference value of a time from the start point of transportation to the point of detection of the leading end of the recording paper by the sheet leading end sensor;

a print control unit for adjusting, when a recording paper of an arbitrary type is fed from the paper feed unit, a print position of an image on the recording paper by controlling the print unit and the registration roller to adjust the length of the image forming period; and an arithmetic unit for obtaining, as a comparative time, a time detected by the time measuring unit when the leading end of the recording paper is detected by the sheet leading end sensor, obtaining a time difference between the obtained comparative time and the reference time stored in the memory unit every time a recording paper is fed from the paper feed unit, and storing the time difference in the memory unit in association with the type of the recording paper, wherein the print control unit adjusts, when a recording paper of a specific type is fed from the paper feed unit, the length of the image forming period in accordance with an adjusted image forming time obtained by subtracting the time difference, previously obtained by the arithmetic unit and stored in the memory unit in association with the specific paper type before the recording paper is fed, from the reference image forming time stored in the memory unit.

6. The image forming apparatus according to claim 5, wherein the print unit includes: an image carrier; a writing unit for writing an electrostatic latent image on the image carrier; a developing unit for developing the electrostatic latent image on the image carrier into a toner image; and a transfer unit for transferring the toner image on the image carrier onto the recording paper, and the print control unit adjusts the length of the image forming period, which is a period from a start point of writing of the electrostatic latent image in a sub-scanning direction by the writing unit to the start point of transportation by the registration roller.

7. The image forming apparatus according to claim 5, further comprising an input operation unit operated to adjust and set the reference image forming time.

8. The image forming apparatus according to claim 5, wherein the print control unit adjusts, when a recording paper of an arbitrary type is fed from the paper feed unit, the length of the image forming period in accordance with an adjusted image forming time determined based on the reference image forming time stored in the memory unit and an average value of the differences obtained by the arithmetic unit and stored in the memory unit before the recording paper is fed and every time another recording paper of the arbitrary type was fed from the paper feed unit.

* * * * *